US011723503B2

(12) United States Patent
Mathieu et al.

(10) Patent No.: US 11,723,503 B2
(45) Date of Patent: Aug. 15, 2023

(54) ROBOTIC CLEANER

(71) Applicant: SHARKNINJA OPERATING LLC, Needham, MA (US)

(72) Inventors: Margaret Mathieu, East Greenwich, RI (US); Charles S. Brunner, Stockton, NJ (US)

(73) Assignee: SharkNinja Operating LLC, Needham, MA (US)

( * ) Notice: Subject to any disclaimer, the term of this patent is extended or adjusted under 35 U.S.C. 154(b) by 304 days.

(21) Appl. No.: 16/941,635

(22) Filed: Jul. 29, 2020

(65) Prior Publication Data

US 2021/0030227 A1 Feb. 4, 2021

Related U.S. Application Data

(60) Provisional application No. 62/886,600, filed on Aug. 14, 2019, provisional application No. 62/879,822, filed on Jul. 29, 2019.

(51) Int. Cl.
*A47L 9/04* (2006.01)
*A47L 9/28* (2006.01)
(Continued)

(52) U.S. Cl.
CPC ..... *A47L 9/2847* (2013.01); *A47L 9/0411* (2013.01); *A47L 9/0455* (2013.01); *A47L 9/0477* (2013.01);
(Continued)

(58) Field of Classification Search
CPC .... A47L 9/2847; A47L 9/0411; A47L 9/0455; A47L 9/0477; A47L 9/0494; A47L 9/2826; A47L 9/2852; A47L 11/282; A47L 11/4011; A47L 11/4041; A47L 11/4058; A47L 11/4061; A47L 2201/04; A47L 2201/06
See application file for complete search history.

(56) References Cited

U.S. PATENT DOCUMENTS 2,416,420 A 2/1947 Taylor
4,976,003 A 12/1990 Williams
(Continued)

FOREIGN PATENT DOCUMENTS

CN 1853549 11/2006
CN 208081168 11/2018
(Continued)

OTHER PUBLICATIONS

PCT Search Report and Written Opinion, dated Oct. 13, 2020, received in corresponding PCT Application No. PCT/US2020/43934, 9 pages.
(Continued)

*Primary Examiner* — David Redding
(74) *Attorney, Agent, or Firm* — Grossman Tucker Perreault & Pfleger, PLLC

(57) ABSTRACT

A robotic cleaner may include a chassis, an agitator assembly configured to engage a surface to be cleaned, and a lift mechanism moveably coupling the agitator assembly to the chassis. The lift mechanism may include a biasing mechanism. The biasing mechanism may be configured to generate a biasing force that urges the agitator assembly in a direction away from the surface to be cleaned. The biasing force may be insufficient to lift the agitator assembly from the surface to be cleaned.

20 Claims, 28 Drawing Sheets

(51) Int. Cl.
*A47L 11/282* (2006.01)
*A47L 11/40* (2006.01)

(52) U.S. Cl.
CPC ..... *A47L 9/0494* (2013.01); *A47L 9/2826* (2013.01); *A47L 9/2852* (2013.01); *A47L 11/282* (2013.01); *A47L 11/4011* (2013.01); *A47L 11/4041* (2013.01); *A47L 11/4058* (2013.01); *A47L 11/4061* (2013.01); *A47L 2201/04* (2013.01); *A47L 2201/06* (2013.01)

(56) References Cited

U.S. PATENT DOCUMENTS

| | | | |
|---|---|---|---|
| 5,347,678 | A | 9/1994 | Williams et al. |
| 5,640,738 | A | 6/1997 | Williams et al. |
| 5,781,960 | A | 7/1998 | Kilstrom et al. |
| 5,819,370 | A | 10/1998 | Stein |
| 5,906,024 | A | 5/1999 | Jailor et al. |
| 5,991,972 | A | 11/1999 | Krebs et al. |
| 6,009,593 | A | 1/2000 | Crouser et al. |
| 6,041,472 | A | 3/2000 | Kasen et al. |
| 6,123,779 | A | 9/2000 | Conrad et al. |
| 6,148,475 | A | 11/2000 | Stross |
| 6,243,917 | B1 | 6/2001 | Conrad |
| 6,261,379 | B1 | 7/2001 | Conrad et al. |
| 6,581,239 | B1 | 6/2003 | Dyson et al. |
| 6,668,420 | B2 | 12/2003 | Hannan et al. |
| 6,836,919 | B2 | 1/2005 | Shinier |
| 7,200,892 | B2 | 4/2007 | Kim |
| 7,246,405 | B2 | 7/2007 | Yan |
| 7,266,861 | B2 | 9/2007 | Stein et al. |
| 7,316,051 | B2 | 1/2008 | Budd |
| 7,350,268 | B2 | 4/2008 | Anderson et al. |
| 7,367,085 | B2 | 5/2008 | Bagwell et al. |
| 7,437,799 | B2 | 10/2008 | Rocke |
| 7,444,206 | B2 | 10/2008 | Abramson et al. |
| 7,448,113 | B2 | 11/2008 | Jones et al. |
| 7,571,511 | B2 | 8/2009 | Jones et al. |
| 7,631,394 | B2 | 12/2009 | Oh et al. |
| 7,827,653 | B1 | 11/2010 | Liu et al. |
| 7,895,706 | B2 | 3/2011 | Mitchell et al. |
| 7,930,797 | B2 | 4/2011 | Yoo |
| 7,945,988 | B2 | 5/2011 | Gordon |
| 8,166,608 | B2 | 5/2012 | Becker et al. |
| 8,424,155 | B2 | 4/2013 | Hawkins et al. |
| 8,474,094 | B2 | 7/2013 | Maguire et al. |
| 8,555,462 | B2 | 10/2013 | Maguire et al. |
| 8,631,541 | B2 | 1/2014 | Tran |
| 8,789,235 | B2 | 7/2014 | Krebs et al. |
| 9,138,117 | B2 | 9/2015 | Yun et al. |
| 9,192,271 | B2 | 11/2015 | Dekkers et al. |
| 9,211,045 | B2 | 12/2015 | Li et al. |
| 9,510,715 | B2 | 12/2016 | Van Den Bogert |
| 9,648,999 | B2 | 5/2017 | Uphoff et al. |
| 9,661,971 | B2 | 5/2017 | Riehl |
| 2005/0166356 | A1 | 8/2005 | Uehigashi |
| 2006/0236491 | A1 | 10/2006 | Baek |
| 2008/0271285 | A1 | 11/2008 | Maurer et al. |
| 2013/0047368 | A1 | 2/2013 | Tran et al. |

FOREIGN PATENT DOCUMENTS

| | | | |
|---|---|---|---|
| DE | 102010000577 | A1 | 8/2011 |
| WO | 0141617 | A1 | 6/2001 |

OTHER PUBLICATIONS

Chinese Office Action with machine generated English translation dated Aug. 1, 2022, received in Chinese Patent Application No. CN202080054876.8, 17 pages.

Chinese Office Action with English summary dated Apr. 19, 2023, received in Chinese Patent Application No. CN202080054876.8, 8 pages.

ROBOTIC CLEANER

CROSS-REFERENCE TO RELATED APPLICATIONS

The present application claims the benefit of U.S. Provisional Application Ser. No. 62/879,822 filed on Jul. 29, 2019, entitled Robotic Cleaner and U.S. Provisional Application Ser. No. 62/886,600 filed on Aug. 14, 2019, entitled Robotic Cleaner, each of which are fully incorporated herein by reference.

TECHNICAL FIELD

The present disclosure is generally directed to autonomous devices and more specifically to robotic cleaners.

BACKGROUND

The following is not an admission that anything discussed below is part of the prior art or part of the common general knowledge of a person skilled in the art.

A surface cleaning apparatus may be used to clean a variety of surfaces. Some surface cleaning apparatuses include a rotating agitator (e.g., brush roll). One example of a surface cleaning apparatus includes a vacuum cleaner which may include a rotating agitator as well as a vacuum source. Non-limiting examples of cleaners include robotic vacuums, robotic sweepers, multi-surface robotic cleaners, wet/dry robotic cleaners, upright vacuum cleaners, canister vacuum cleaners, stick vacuum cleaners, and central vacuum systems.

Within the field of robotic and autonomous cleaning devices, there are a range of form factors and features that have been developed to meet a range of cleaning requirements. However, certain cleaning applications remain a challenge.

Wet floor cleaning in the home has traditionally involved manual labor and generally a tool consisting of a wet mop or sponge attached to the end of a handle. The mop or sponge is used to apply a cleaning fluid onto the surface of a floor. The cleaning fluid is applied and the tool is used to agitate the surface of the floor through a scrubbing motion. The components of the cleaning fluid and the scrubbing agitation helps suspend any dirt or contaminants on the surface into the cleaning fluid. The contaminants are then removed from the surface of the floor as the tool removes the cleaning fluid, generally by having the mop or the sponge absorb the cleaning fluid, and thus the dirt or contaminants. Water may be used to perform wet cleaning on floors, but often it is more effective to use a cleaning fluid that is a mixture of water and soap or detergent that reacts with contaminants to emulsify the contaminants into the water. A cleaning fluid may further include other components such as a solvent, a fragrance, a disinfectant, a drying agent, abrasive particulates and the like to increase the effectiveness of the cleaning process, or improve the end-results such as floor appearance.

As referenced above, the sponge or mop may be used as a scrubbing element for scrubbing the floor surface, particularly with stubborn stains and particulate matter. The scrubbing action serves to agitate the cleaning fluid for mixing with contaminants as well as to apply a friction force for loosening contaminants from the floor surface. Agitation enhances the dissolving and emulsifying action of the cleaning fluid and the friction force helps to break bonds between the surface and contaminants.

Dry debris is generally removed prior to the wet floor cleaning either using a vacuum or via dry mopping. This minimizes the contamination of cleaning fluid and cleaning tools used during the wet floor cleaning. But this additional step adds time and labor to the cleaning process.

BRIEF SUMMARY

An example of a robotic cleaner, consistent with the present disclosure, may include a chassis, an agitator assembly configured to engage a surface to be cleaned, and a lift mechanism moveably coupling the agitator assembly to the chassis. The lift mechanism may include a biasing mechanism. The biasing mechanism may be configured to generate a biasing force that urges the agitator assembly in a direction away from the surface to be cleaned. The biasing force may be insufficient to lift the agitator assembly from the surface to be cleaned.

In some instances, the lift mechanism may include a top plate, a bottom plate, and a plurality of linkages, a first end of each linkage being pivotally coupled to the top plate and a second end of each linkage being slidably coupled to the bottom plate. In some instances, the top plate may be coupled to the chassis and the bottom plate may be coupled to the agitator assembly. In some instances, the biasing mechanism may be configured to urge the linkages to pivot towards each other. In some instances, the biasing mechanism may be a tension spring. In some instances, the biasing mechanism may be a leaf spring. In some instances, the agitator assembly may include at least one motor. In some instances, the lift mechanism may include a plurality of biasing mechanisms, the plurality of biasing mechanisms being configured to cooperate to encourage an even weight distribution across the agitator assembly. In some instances, the agitator assembly may include at least one agitator, the at least one agitator being configured to be rotated by the at least one motor. In some instances, the agitator assembly may include at least one counterweight, the at least one counterweight and the at least one motor being positioned on opposing sides of the agitator assembly.

Another example of a robotic cleaner, consistent with the present disclosure, may include a chassis, a suction motor, a dust cup fluidly coupled to the suction motor, an agitator assembly configured to engage a surface to be cleaned, the agitator assembly being fluidly coupled to the dust cup, and a lift mechanism moveably coupling the agitator assembly to the chassis. The lift mechanism may include a biasing mechanism. The biasing mechanism may be configured to generate a biasing force that urges the agitator assembly in a direction away from the surface to be cleaned. The biasing force may be insufficient to lift the agitator assembly from the surface to be cleaned.

In some instances, a bellow may fluidly couple the agitator assembly to the dust cup. In some instances, the lift mechanism may include a top plate, a bottom plate, and a plurality of linkages, a first end of each linkage being pivotally coupled to the top plate and a second end of each linkage being slidably coupled to the bottom plate. In some instances, the top plate may be coupled to the chassis and the bottom plate may be coupled to the agitator assembly. In some instances, the biasing mechanism may be configured to urge the linkages to pivot towards each other. In some instances, the biasing mechanism may be a tension spring. In some instances, the biasing mechanism may be a leaf spring. In some instances, the agitator assembly may include at least one motor. In some instances, the lift mechanism may include a plurality of biasing mechanisms, the plurality of biasing mechanisms being configured to cooperate to encourage an even weight distribution across the agitator assembly. In some instances, the agitator assembly may include at least one counterweight, the at least one counterweight and the at least one motor being positioned on opposing sides of the agitator assembly.

BRIEF DESCRIPTION OF THE DRAWINGS

These and other features and advantages will be better understood by reading the following detailed description, taken together with the drawings wherein:

FIG. 11 is a front view of the agitator assembly of a robotic cleaner of FIG. 10, consistent with embodiments of the present disclosure.

DETAILED DESCRIPTION

Figure 1A:
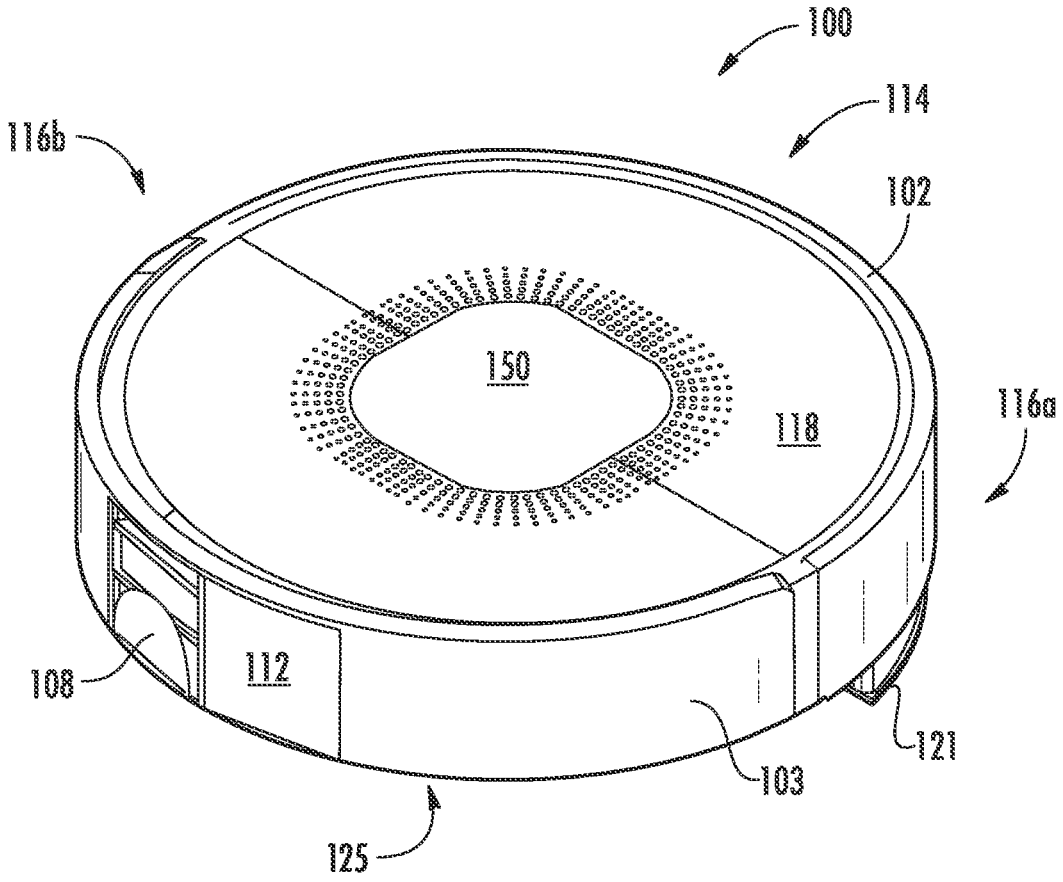
FIG. 1A is a perspective top view a robotic cleaner, consistent with embodiments of the present disclosure.
Figure 1B:
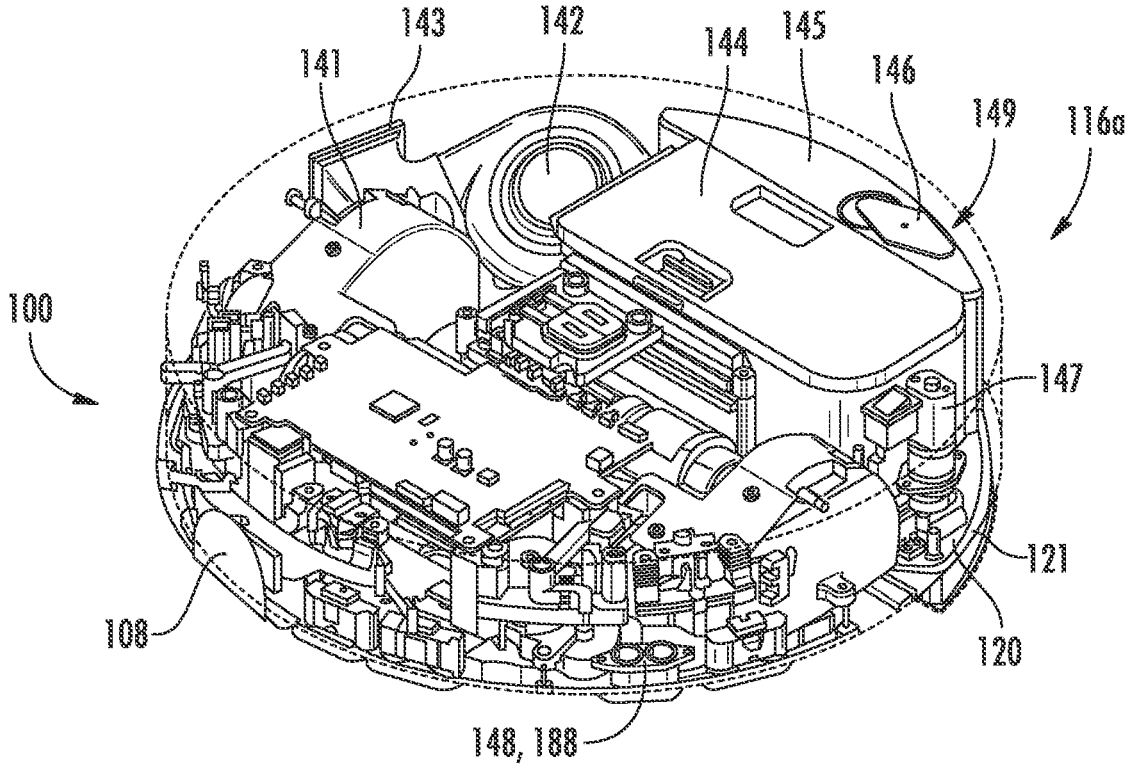
FIG. 1B is another perspective top view of the robotic cleaner shown in FIG. 1, wherein at least a portion of the robotic cleaner is shown as transparent for purposes of clarity, consistent with embodiments of the present disclosure.
Figure 2A:
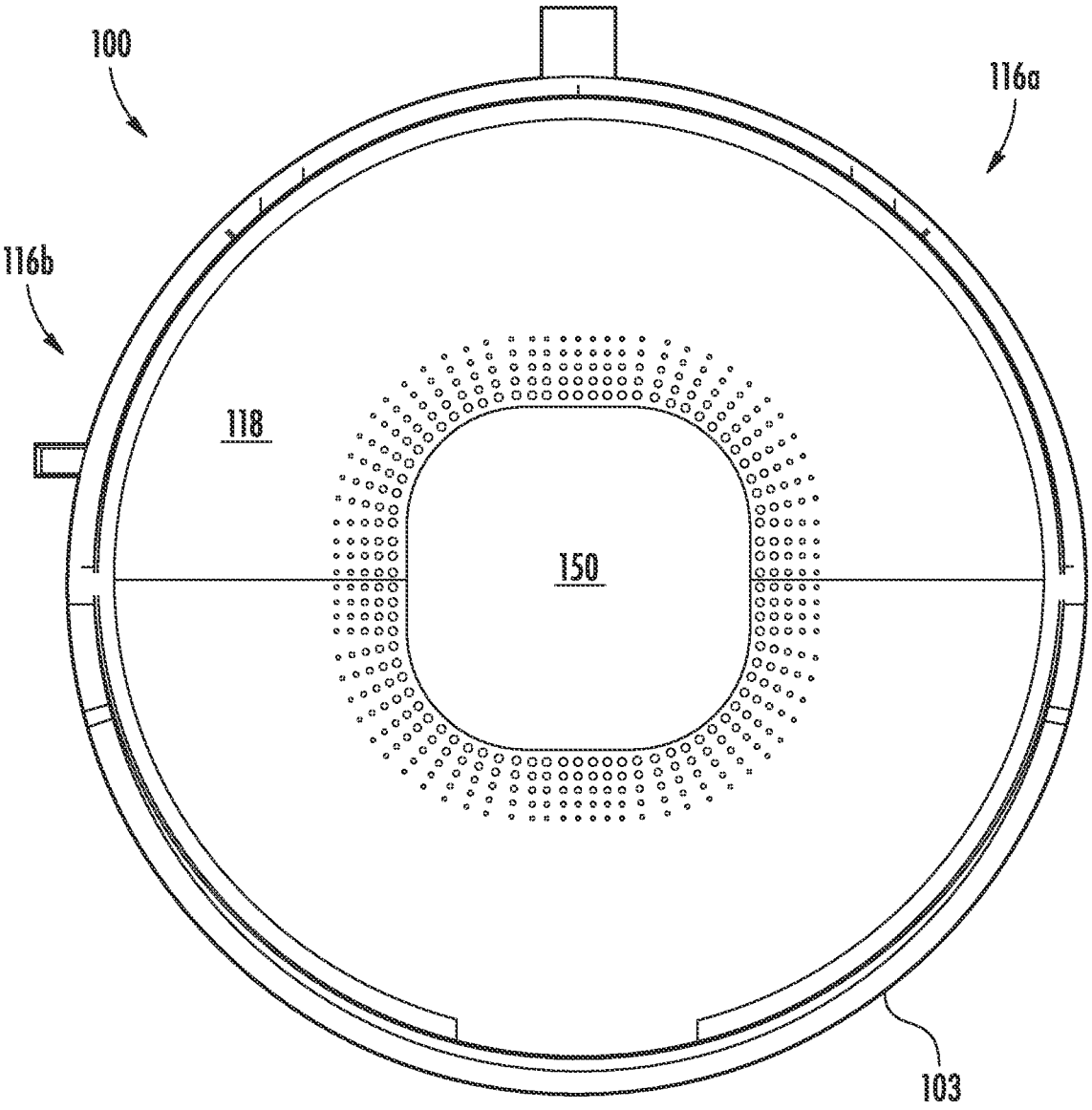
FIG. 2A is a top view of the robotic cleaner shown in FIG. 1, consistent with embodiments of the present disclosure.
Figure 2B:
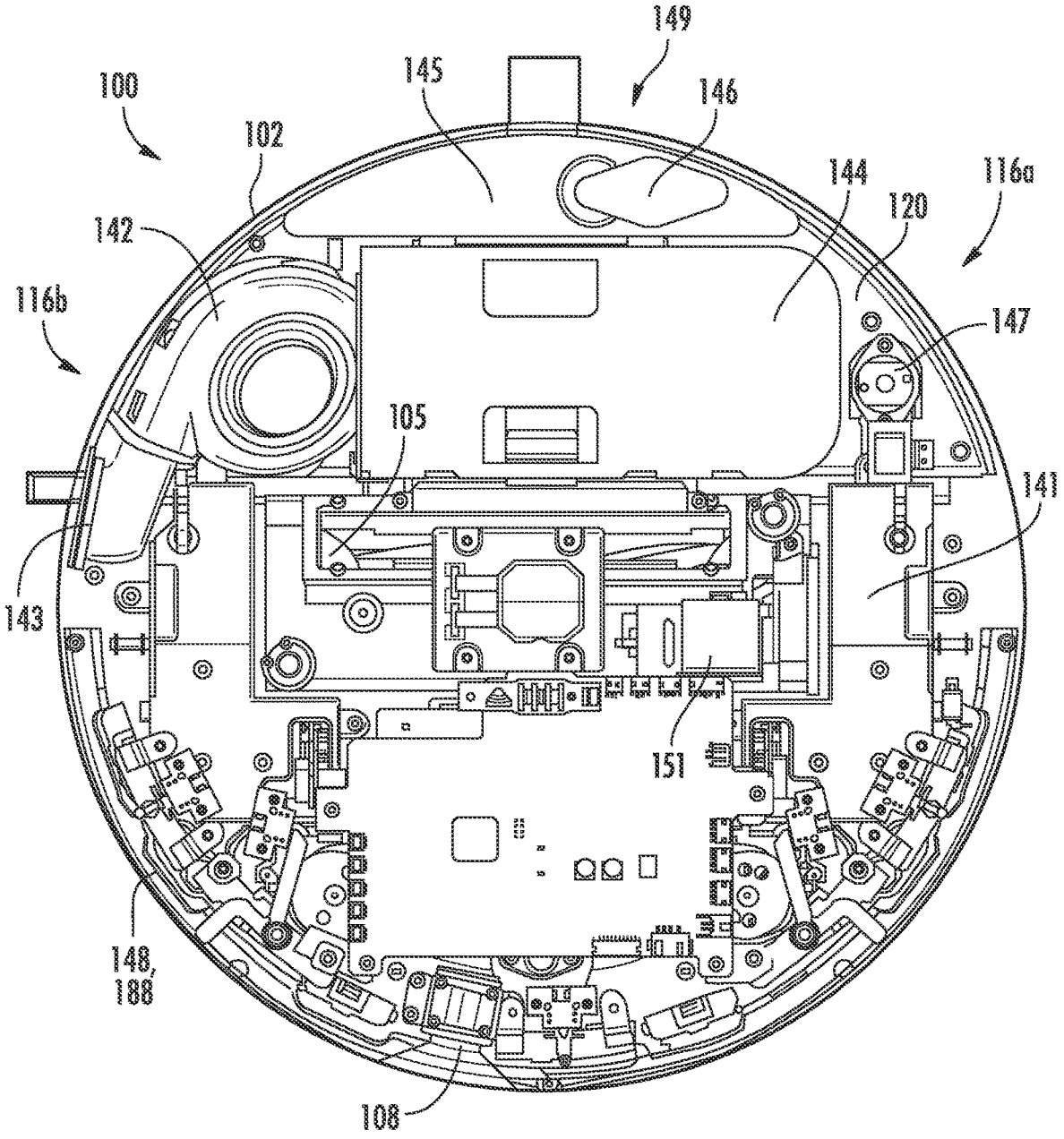
FIG. 2B is a top view of the robotic cleaner shown in FIG. 1 having a top portion removed therefrom for purposes of clarity, consistent with embodiments of the present disclosure.
Figure 3:
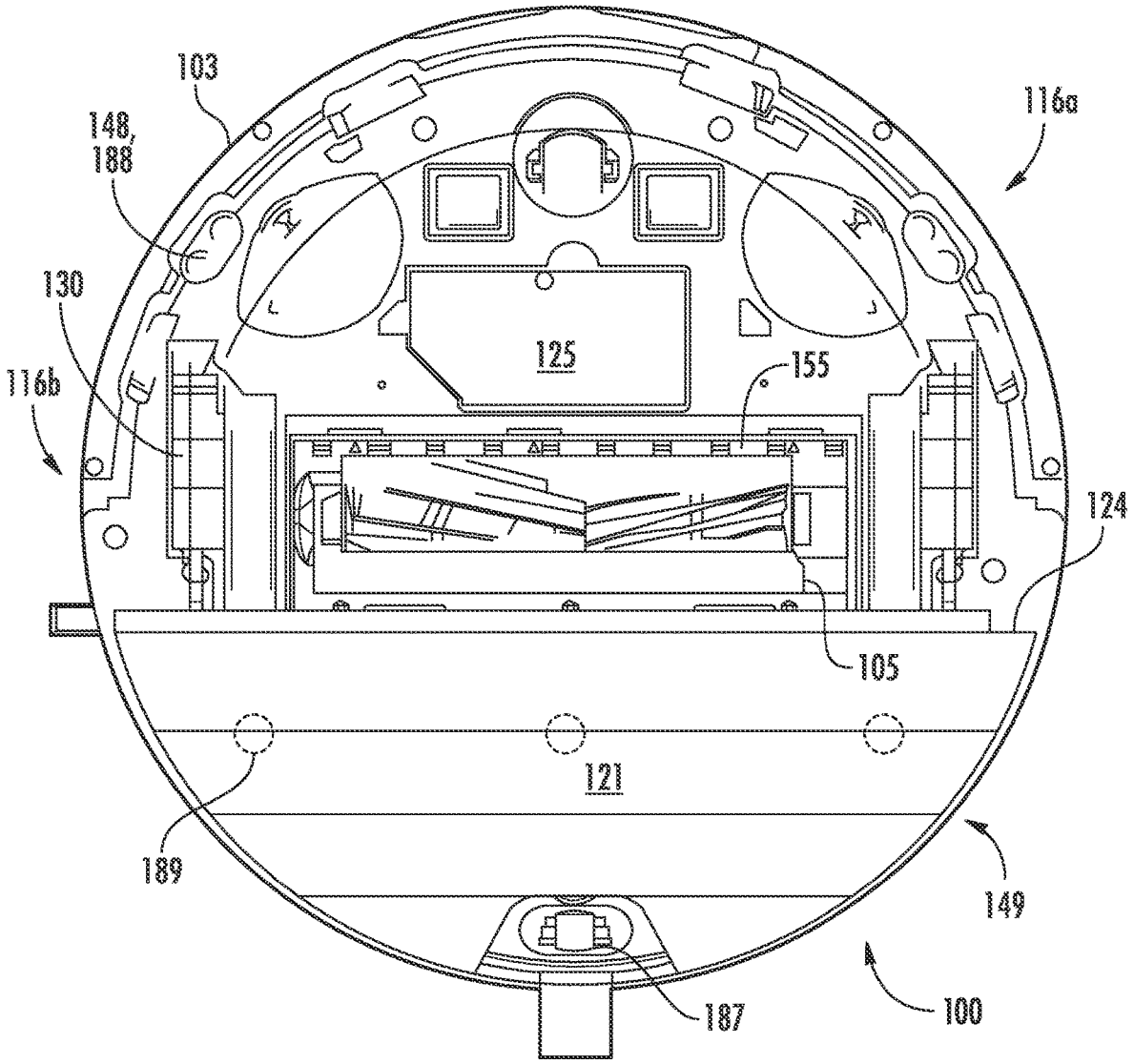
FIG. 3 is a bottom view of the robotic cleaner shown in FIG. 1, consistent with embodiments of the present disclosure.

The present disclosure is generally directed to a robotic cleaner. The robotic cleaner may include a suction motor, a dust cup, an air inlet, an agitator assembly, and a lift mechanism. The agitator assembly may include a housing and one or more agitators (e.g., a brush roll) rotatably coupled to the housing. The lift mechanism is coupled to the agitator assembly (e.g., the housing) and is configured such that the agitator assembly moves in response to changes in a surface to be cleaned (e.g., in response to a change in surface type such as from carpet to hardwood). Movement of the agitator assembly relative to the surface to be cleaned causes a corresponding movement of the one or more agitators relative to the surface to be cleaned. As such, the one or more agitators may be encouraged to maintain a consistent engagement (e.g., contact) with the surface to be cleaned.

The lift mechanism includes a biasing mechanism (e.g., a tension spring) and at least two pivoting linkages, wherein the linkages pivot in response to movement of the agitator assembly. The biasing mechanism extends between and is coupled to the linkages. The biasing mechanism can be configured such that the biasing mechanism urges the linkages to pivot in a direction that urges the agitator assembly to move away from the surface to be cleaned, wherein the force exerted by biasing mechanism is insufficient to cause the agitator assembly to move away from the surface to be cleaned. As such, the biasing mechanism can generally be described as being configured to reduce an amount of force required to move the agitator assembly. Such a configuration may allow the agitator assembly to move more easily when the robotic cleaner is traversing the surface to be cleaned.

The suction motor is fluidly coupled to the dust cup and the air inlet such that the suction motor urges air to flow along an airflow path that extends through at least a portion of the agitator assembly, into the air inlet, and through the dust cup and suction motor. The air flowing along the airflow path may have debris entrained therein. As the air flows through the dust cup, at least a portion of the debris entrained within the air may fall out of entrainment and be deposited in the dust cup before the air passes through the suction motor. In some instances, the housing may define at least a portion of the air inlet. In this instance, movement of the agitator assembly relative to the surface to be cleaned may encourage air to flow into the agitator assembly at a substantially constant velocity, which may encourage a consistent suction (or vacuum) force to be generated within the agitator assembly.

As used herein, the terms "above" and "below" are used relative to an orientation of the cleaning apparatus on a surface to be cleaned and the terms "front" and "back" are used relative to a direction that the cleaning apparatus moves on a surface being cleaned during normal cleaning operations (i.e., back to front). As used herein, the term "leading" refers to a position in front of at least another component but does not necessarily in front of all other components.

Acoustic sensor, as used herein, may generally refer to a sensor configured to detect sounds within the human audible range (e.g., between 20 Hz and 20,000 Hz). Ultrasonic sensor, as used herein, may generally refer to a sensor configured to detect sounds in an ultrasonic range (e.g., greater than 20,000 Hz).

Referring to FIGS. 1A-3, an embodiment of a robotic cleaner 100, consistent with embodiments of the present disclosure, is shown and described. Although a particular embodiment of a robotic cleaner is shown and described herein, the concepts of the present disclosure may apply to other types of robotic vacuum cleaners or robotic cleaners. The robotic cleaner 100 includes a housing or chassis 102 with a front side 112, and a back side 114, left and right sides 116*a*, 116*b*, an upper side (or top surface) 118, and a lower or under side (or bottom surface) 125. A bumper 103 is movably coupled to the housing and/or robotic cleaner chassis 102. The bumper 103 may extend around at least a portion (e.g., a substantial portion) of a forward portion of the housing 102. The top of the housing 102 may include controls (or a user interface) 150 to initiate one or more operations, such as autonomous cleaning, spot cleaning, and docking and indicators (e.g., LEDs) to indicate operations, battery charge levels, errors and other information. For example, the controls 150 may include one or more buttons configured to initiate one or more operations.

As shown, the robotic cleaner 100 includes a suction conduit (or air inlet) 155 fluidly coupled to a dust cup 144 and a suction motor 142. The suction motor 142 causes debris to be suctioned into the suction conduit 155 and deposited into the dust cup 144 for later disposal. An air exhaust port 143 is fluidly coupled to the suction motor 142. In various embodiments, the air exhaust port 143 may be configured such that air exhausted therefrom urges debris towards a common location, encourages a drying of a liquid cleaning fluid, and/or does not cause undesirable debris agitation.

As also shown, the robotic cleaner 100 includes a plurality of wheels 130 coupled to a respective drive motor contained within a driven wheel assembly 141. As such, each wheel 130 may generally be described as being independently driven. The robotic cleaner 100 can be steered by adjusting the rotational speed of one of the plurality of wheels 130 relative to the other of the plurality of wheels 130.

A displaceable bumper 103 can be disposed along a portion of a perimeter defined by a housing 102 of the robotic cleaner 100. The displaceable bumper 103 is configured to transition between an unactuated position and an actuated position in response to engaging, for example, an obstacle. The displaceable bumper 103 can be configured to be moveable along a first axis extending generally parallel to a top surface of the housing 102. As such, the displaceable bumper 103 is displaced in response to engaging (e.g., contacting) at least a portion of an obstacle disposed on and extending from a surface to be cleaned. Additionally, or alternatively, the displaceable bumper 103 can be configured to be moveable along a second axis that extends transverse to (e.g., perpendicular to) the first axis. As such, the displaceable bumper 103 is displaced in response to engaging (e.g., contacting) at least a portion of an obstacle that is spaced apart from the surface to be cleaned. Therefore, the robotic cleaner 100 may avoid becoming trapped between the obstacle and the surface to be cleaned.

A user interface 150 can be provided to allow a user to control the robotic cleaner 100. For example, the user interface 150 may include one or more push buttons that correspond to one or more features of the robotic cleaner 100. Liquid ingress protection may be provided at the user interface 150 to prevent or otherwise mitigate the effects of a liquid being inadvertently spilled on the housing 102 of the robotic cleaner 100.

The robotic cleaner 100 includes an agitator 105 (e.g., a main brush roll). The agitator 105 is configured to rotate such that is urges debris towards the suction conduit 155. The agitator 105 rotates about a rotation axis that extends substantially (e.g., within 1°, 2°, 3°, 4°, or 5° of) parallel to a surface to be cleaned. In other words, the agitator 105 may generally be described as being configured to rotate about a substantially horizontal axis.

The agitator 105 is at least partially disposed within the suction conduit 155. The agitator 105 may be coupled to a motor 151, such as AC or DC motor. The motor 151 is configured to impart rotation to the agitator 105 by way of, for example, one or more of one or more drive belts, one or more gears, and/or any other driving mechanisms. The robotic cleaner may also include one or more rotating side brushes coupled to motors to urge debris towards the agitator 105 (not shown). In an alternative embodiment, the robotic cleaner may also include one or more air jet assemblies configured to urge debris toward the agitator 105.

The agitator 105 may have bristles, fabric, or other cleaning elements, or any combination thereof around the outside of the agitator 105. The agitator 105 may include, for example, strips of bristles in combination with strips of a rubber or elastomer material. The agitator 105 may also be removable to allow the agitator 105 to be cleaned more easily and allow the user to change the size of the agitator 105, change a type of bristles on the agitator 105, and/or remove the agitator 105 entirely depending on the intended application. The robotic cleaner 100 may further include a bristle strip (not shown) on an underside of the housing 102 and along a portion of the suction conduit 155. The bristle strip may include bristles having a length sufficient to at least partially contact the surface to be cleaned. The bristle strip may also be angled, for example, toward the suction conduit 155.

The robotic cleaner 100 also includes several different types of sensors. For example, the robotic cleaner 100 may include one or more forward obstacle sensors 108. The one or more forward obstacle sensors 108 may be integrated with and/or separate from the bumper 103. For example, the one or more forward obstacle sensors 108 may be configured to cooperate with the bumper 103 such that signals emitted from the one or more forward obstacle sensors 108 can pass through at least a portion of the bumper 103. The one or more forward obstacle sensors 108 may include one or more of infrared sensors, ultrasonic sensors, time-of-flight sensors, a camera (e.g., a stereo or monocular camera), and/or any other sensor.

By way of further example, one or more floor type detection sensors 148, 188 (e.g., an acoustic sensor or ultrasonic sensor) may be used to detect qualities of the floor surface on which the robotic cleaner 100 travels and/or changes in the qualities of the floor surface on which the robotic cleaner 100 travels. The one or more floor type detection sensors 148, 188 can be any suitable sensors operable to detect a physical condition or phenomena and provide the corresponding data to a controller configured to control a behavior of the robotic cleaner 100 such as a movement behavior (e.g., avoid carpeted surfaces when wet cleaning), a cleaning behavior (e.g., suction power, agitator speed, or side brush speed), an escape behavior, and/or any other behavior. In some instances, the algorithms that control the behavior of the robotic cleaner 100 are selected based on the determination of the surface type by the floor type detection sensors 148, 188. In other embodiments, the algorithms that control the behavior of the robotic cleaner 100 are selected based on the identification of a change in the surface type by the floor type detection sensors 148, 188.

In one embodiment, an acoustic sensor 148 allows for determination of floor types such as carpet, hardwood, and/or tile based on the reflective conditions of the floor. The acoustic sensor 148 may be configured to identify changes between a first floor type and a second floor type during operation of the robotic cleaner 100. As the robotic cleaner 100 traverses a target surface, noise from the surrounding area may be detected using the acoustic sensor 148. The volume and quality of that noise may vary based on the qualities of the floor surface such that the acoustic sensor 148 allows for determination of floor types such as carpet, hardwood, and/or tile based on the reflective conditions of the floor, or a transition from a first type to a second type of floor covering. In some embodiments, the noise that the robotic cleaner generates while moving is used by an acoustic sensor 148 to determine floor type. This noise may be caused by the plurality of wheels 130 traveling over a surface or by operation of the suction motor 142. The acoustic sensor 148 may be placed into a recessed chamber within the robotic cleaner chassis 102. In some embodiments, the recessed chamber may be cylindrical, such that the location of the source of ambient noise detected by the acoustic sensor 148 is more readily identified.

Another embodiment includes a method for detecting the floor using an ultrasonic sensor 188. Such a floor sensor 188 comprises an ultrasonic sensor 188 transmitting an ultrasonic signal towards the floor surface and receiving the ultrasonic signal reflected from the floor surface. The sensor 188 allows for determination of floor types such as carpet, hardwood, and/or tile based on the reflective conditions of the floor. The ultrasonic sensor 188 may be configured to identify changes between a first floor type and a second floor type during operation of the robotic cleaner 100.

An example embodiment of the robotic cleaner 100 includes at least one ultrasonic sensor 188 and at least one acoustic sensor 148. The at least one ultrasonic sensor 188 and the at least one acoustic sensor 148 may operate together to determine a floor surface and/or a change in the floor surface. That is, the at least one ultrasonic sensor 188 may transmit an ultrasonic signal towards the floor surface. The at least one ultrasonic sensor 188 and the at least one acoustic sensor 148 may both receive the reflected signal and use the signals to determine a floor type and/or a change in the floor type. In some embodiments, the at least one ultrasonic sensor 188 may be configured to operate based on signals received by the at least one acoustic sensor 148. That is, should the at least one acoustic sensor 148 determine a change in the floor surface, the at least one ultrasonic sensor 188 may be configured to emit an ultrasonic signal based on that determination.

The robotic cleaner 100 may include a wet cleaning module 149 removably affixed to the robotic cleaner chassis 102. The wet cleaning module 149 includes a cleaning fluid tank 145 and a stopper for the cleaning fluid tank 146. The cleaning fluid tank 146 further includes a tank base 120 which is connected to a wet cleaning module motor 147. A wet cleaning pad 121 is operatively connected to the tank base 120 via a wet pad plate (not shown). As the robotic cleaner travels across a floor, the suction conduit 155, which is fluidly coupled to the suction motor 142, collects dry debris from the floor while the wet cleaning module 149 applies a cleaning fluid onto the cleaning pad 121 at one or more pump outlet locations 189 (hidden lines), and uses the cleaning pad 121 to scrub the floor. The wet cleaning module motor 147 powers one or more pumps configured to apply the cleaning fluid onto the cleaning pad 121 and to agitate the cleaning pad 121 during cleaning.

A non-driven rear caster wheel 187 supports the wet cleaning module 149. The rear caster wheel 187 is used to control the engagement of the cleaning pad 121 with the target surface. The rear caster wheel 187 may be shifted along a vertical axis such that the cleaning pad 121 carried by the robotic cleaner 100 sits closer to or further from the surface on which it travels. When the rear caster wheel 187 rotates at a higher axis relative to the bottom of the robotic cleaner 100, the cleaning pad 121 has greater engagement with the floor. This may increase the cleaning effectiveness. However, the increased mechanical engagement with the floor may also produce increased friction from the cleaning pad 121 as it moves over the surface being cleaned. The increased friction may decrease the speed of the robotic cleaner 100. Therefore, the rear caster wheel 187 can be adjusted such that the pressure caused by the weight of the robotic cleaner 100 is balanced between cleaning effectiveness and maneuverability of the robotic cleaner 100. The pressure applied to the cleaning pad 121 may be distributed across the surface area of the cleaning pad 121 engaging with the surface being cleaned, or in an alternative embodiment, the pressure applied to the cleaning pad 121 may be concentrated along a leading edge of the cleaning pad 121. The concentration of the pressure along the leading edge of the cleaning pad 121 can be configured to provide improved cleaning as a result of increased mechanical engagement with the floor being cleaned while limiting the amount of drag caused by the cleaning pad 121 engagement with the floor.

Figure 4:
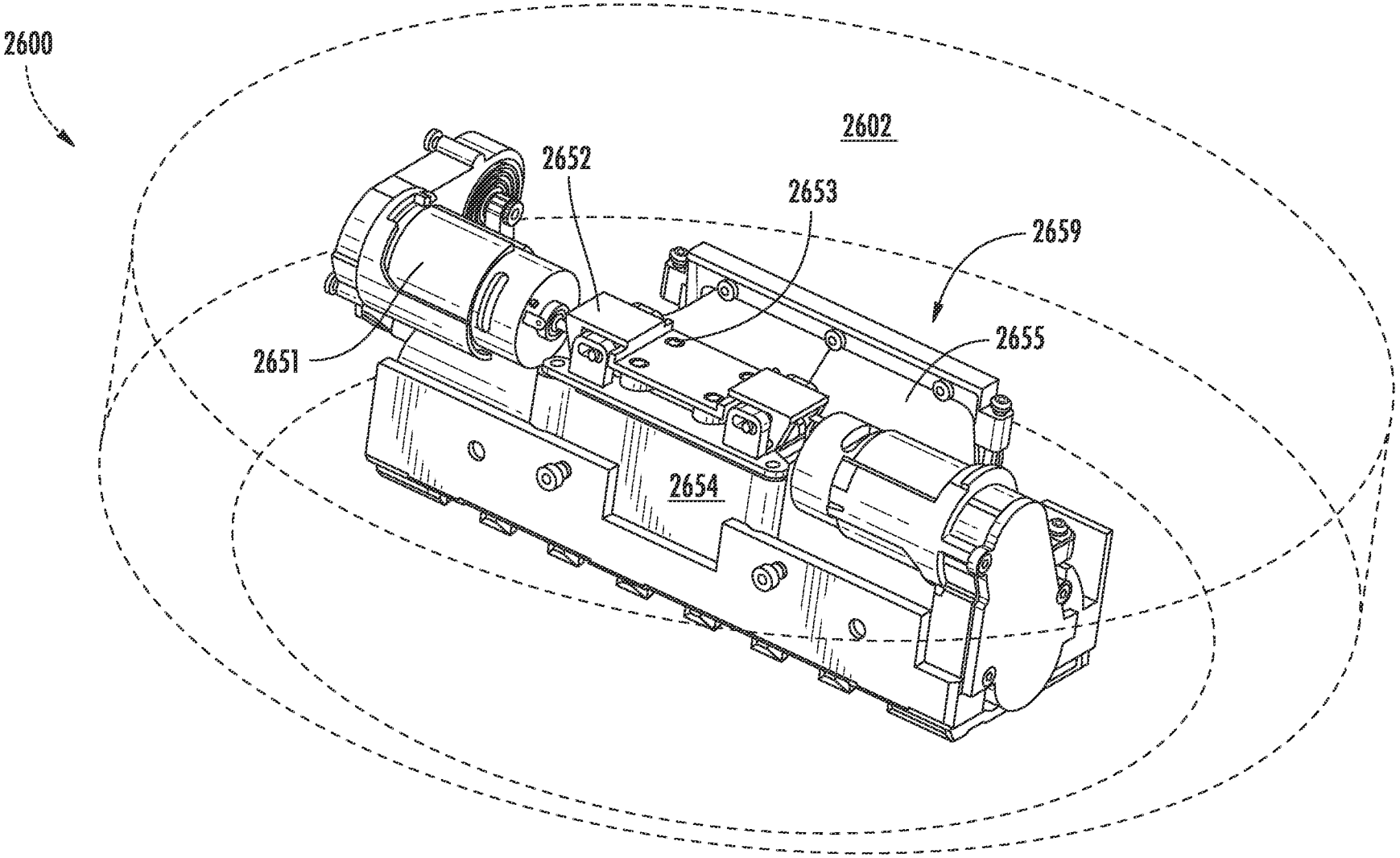
FIG. 4 is a schematic perspective view of a robotic cleaner having an agitator assembly, wherein the robotic cleaner is shown as transparent for purposes of clarity, consistent with embodiments of the present disclosure.
Figure 5:
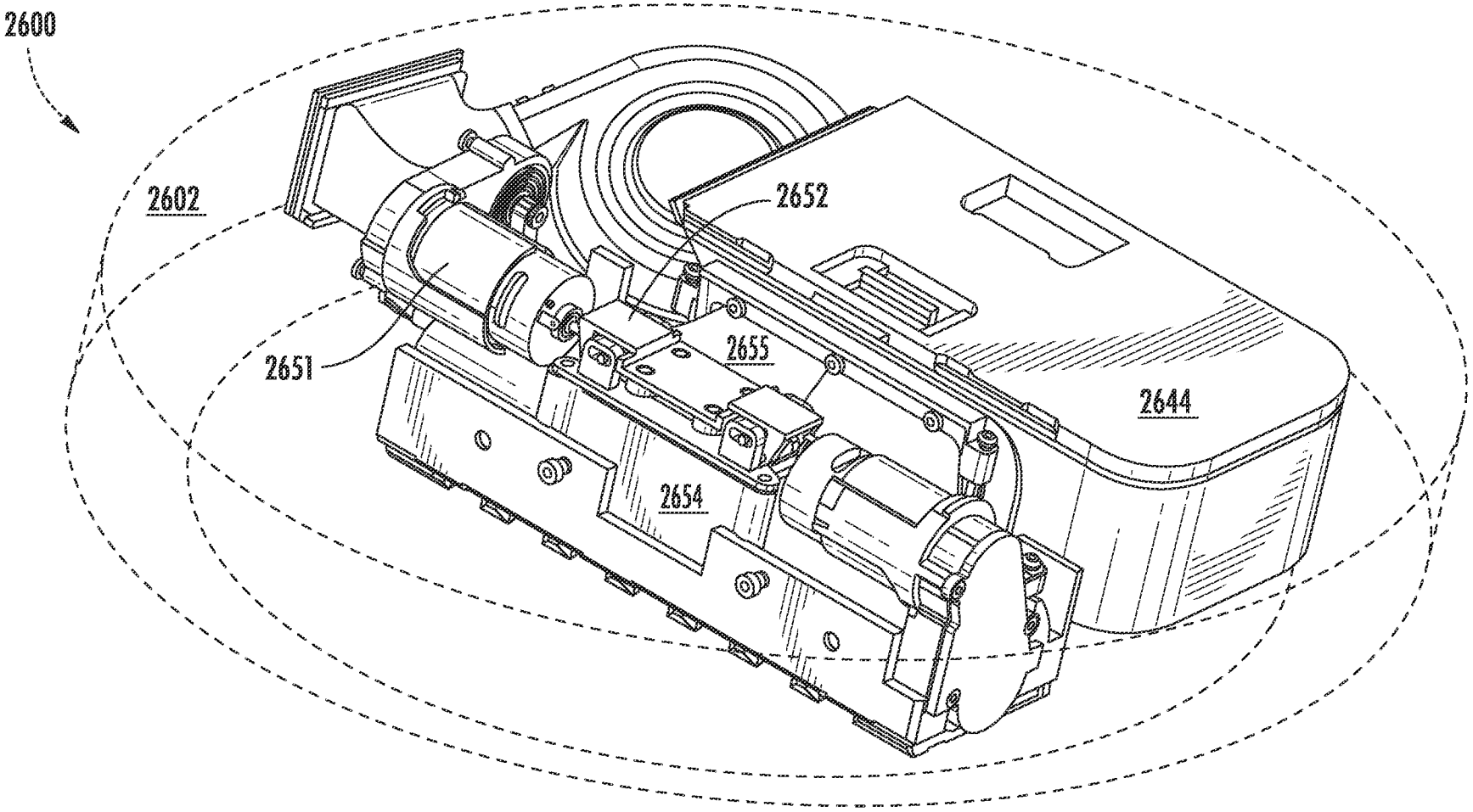
FIG. 5 is a schematic perspective view of the robotic cleaner of FIG. 4 having the agitator assembly and a dust cup, wherein the robotic cleaner is shown as transparent for purposes of clarity, consistent with embodiments of the present disclosure.

FIGS. 4 and 5 show a robotic cleaner 2600. As shown, the robotic cleaner 2600 includes a chassis 2602, an agitator assembly 2659 disposed within the chassis 2602, and a lift mechanism 2652 coupled to the agitator assembly 2659. The agitator assembly 2659 can include a housing 2654, a motor 2651, one or more agitators (e.g., one or more brush rolls), and a bellow 2655. The lift mechanism 2652 is configured such that the agitator assembly 2659 can move relative to the chassis 2602. The lift mechanism 2652 can include a plurality of cleaner attachment points 2653 that are configured to couple the lift mechanism 2652 to the chassis 2602. As such, the agitator assembly 2659 can generally be described as being configured to float. In some instances, the agitator assembly 2659 may operate as a floating sole plate. Additional reference is made to FIGS. 6-8, which show magnified views of the lift mechanism 2652 illustrated in FIGS. 4 and 5.

The agitator assembly 2659 forms a suction conduit (or air inlet) that is fluidly coupled to a dust cup 2644 and a suction motor. The suction motor causes air to flow along an air flow path that passes through the suction conduit, into the dust cup 2644, and through the suction motor. The air flowing along the airflow path may have debris entrained therein. At least a portion of the entrained debris may be deposited in the dust cup 2644 for later disposal.

The bellow 2655 is fluidly coupled to the agitator assembly 2659 (e.g., to the suction conduit) and to the dust cup 2644. As such, the bellow 2655 is disposed between the agitator assembly 2659 and the dust cup 2644 such that air flowing along the airflow path passes through the agitator assembly 2659 and the bellow 2655 before passing through the dust cup 2644. The bellow 2655 can be constructed of a flexible material such that the agitator assembly 2659 can move relative to the chassis 2602 of the robotic cleaner 2600 while remaining fluidly coupled to the dust cup 2644. For example, the bellow 2655 may include a rubber (e.g., natural or synthetic rubber). In some instances, a first end of the bellow 2655 is coupled to the agitator assembly 2659 and a second end of the bellow 2655 is coupled to the chassis 2602 such that the bellow 2655 fluidly couples to the dust cup 2644. The first end of the bellow 2655 is opposite the second end of the bellow 2655.

The agitator assembly 2659 is configured to move between an extended position and a retracted position. When the agitator assembly 2659 is in the extended position, the lift mechanism 2652 is fully extended (e.g., the lift mechanism 2652 may fully extend in response to the robotic cleaner 2600 being lifted from the surface to be cleaned), preventing further movement of the agitator assembly 2659 in a direction away from the chassis 2602. When the agitator assembly 2659 is in the retracted position, the lift mechanism 2652 cannot retract any further, preventing further movement of the agitator assembly 2659 in a direction towards the chassis 2602. During operation, the agitator assembly 2659 moves between at least two intermediary positions, the intermediary positions being between the extended position and the retracted position.

The maximum extension and retraction of the lift mechanism 2652 may be limited by one or more stops (e.g., defined by or coupled to the chassis 2602). The one or more stops can be configured to engage the agitator assembly 2659, preventing additional extension or retraction of the lift mechanism 2652. The position of the lift mechanism 2652 when the agitator assembly 2659 is engaging a respective stop may generally be described as the position where the lift mechanism 2652 is fully extended or fully retracted. The one or more stops may be further configured to dampen any sound generated as a result of the agitator assembly 2659 engaging the one or more stops (e.g., the stops may include a rubber or compressible foam).

The surface on which the robotic cleaner 2600 travels may displace the agitator assembly 2659 from the extended position such that the agitator assembly 2659 moves towards the retracted position and at least partially into the chassis 2602 of the robotic cleaner 2600. For example, while the robotic cleaner 2600 traverses the surface to be cleaned, the agitator assembly 2659 may move along an assembly axis 2790 (e.g., a vertical axis). Carpet, hard wood, tile, rugs, and other flooring types may have different features that influence a magnitude of the displacement of the agitator assembly 2659. The displacement of the agitator assembly 2659 along the assembly axis 2790 may, for example, measure in a range of 7 millimeters (mm) to 11 mm. By way of further example, the displacement of the agitator assembly 2659 along the assembly axis 2790 may measure in a range of 4 mm to 10 mm. By way of still further example, the displacement of the agitator assembly 2659 along the assembly axis 2790 may measure 7 mm. The total displacement of the agitator assembly 2659 may allow the robotic cleaner 2600 to operate effectively on multiple types of surfaces.

During operation, a lower planar surface of the agitator assembly 2659 extends substantially (e.g., within 1°, 2°, 3°, 4°, or 5° of) parallel to the surface to be cleaned. The distance between the agitator assembly 2659 and the surface to be cleaned may influence a suction force generated at the suction conduit of the agitator assembly 2659. The distance between the agitator assembly 2659 and the surface to be cleaned may further influence an amount of engagement between the agitator of the agitator assembly and the surface to be cleaned. For example, when transitioning from a high pile carpet to a hardwood floor the agitator assembly may move towards the hardwood floor, encouraging a consistent engagement between the agitator and the surface to be cleaned. When compared to a fixed agitator assembly, movement of the agitator assembly 2659 towards the hardwood floor may increase agitation of the surface, encouraging additional dry debris to be suctioned into the dust cup 2644.

The lift mechanism 2652 is configured to allow the agitator assembly 2659 to move along the assembly axis 2790 in response to changes in the surface to be cleaned (e.g., transitions between floor types). In other words, the lift mechanism 2652 may be described as being configured to allow the agitator assembly 2659 to move relative to the chassis 2602 of the robotic cleaner 2600 (e.g., towards or away from an upper portion of the chassis 2602) in response to changes in the surface to be cleaned.

A weight of the agitator assembly 2659 may interfere with a movement of the agitator assembly 2659 in response to changes in the surface to be cleaned. As such, in some instances, the lift mechanism 2652 can be configured to offset at least a portion of the weight of the agitator assembly 2659. For example, the lift mechanism 2652 may include a biasing mechanism (e.g., a spring) configured to urge the lift mechanism 2652 towards the retracted position, wherein a force exerted by the biasing mechanism is insufficient to cause the agitator assembly 2659 to move towards the chassis 2602. Offsetting at least a portion of the weight of the agitator assembly 2659 using the lift mechanism 2652 may encourage better engagement between the agitator assembly 2659 and the surface to be cleaned. If the agitator assembly 2659 is not sufficiently displaced, power consumption may be increased when the robotic cleaner 2600 moves over some surfaces. Additional power consumption on surfaces such as carpet may prevent the robotic cleaner 2600 from effectively completing tasks. For example, a distance of approximately 1 mm may extend between the agitator assembly 2659 (e.g., a bottom most portion of the agitator assembly 2659) and the surface to be cleaned. Such a configuration may cause sufficient suction to be generated such that debris is removed from the surface to be cleaned while minimizing power consumption.

Figure 6:
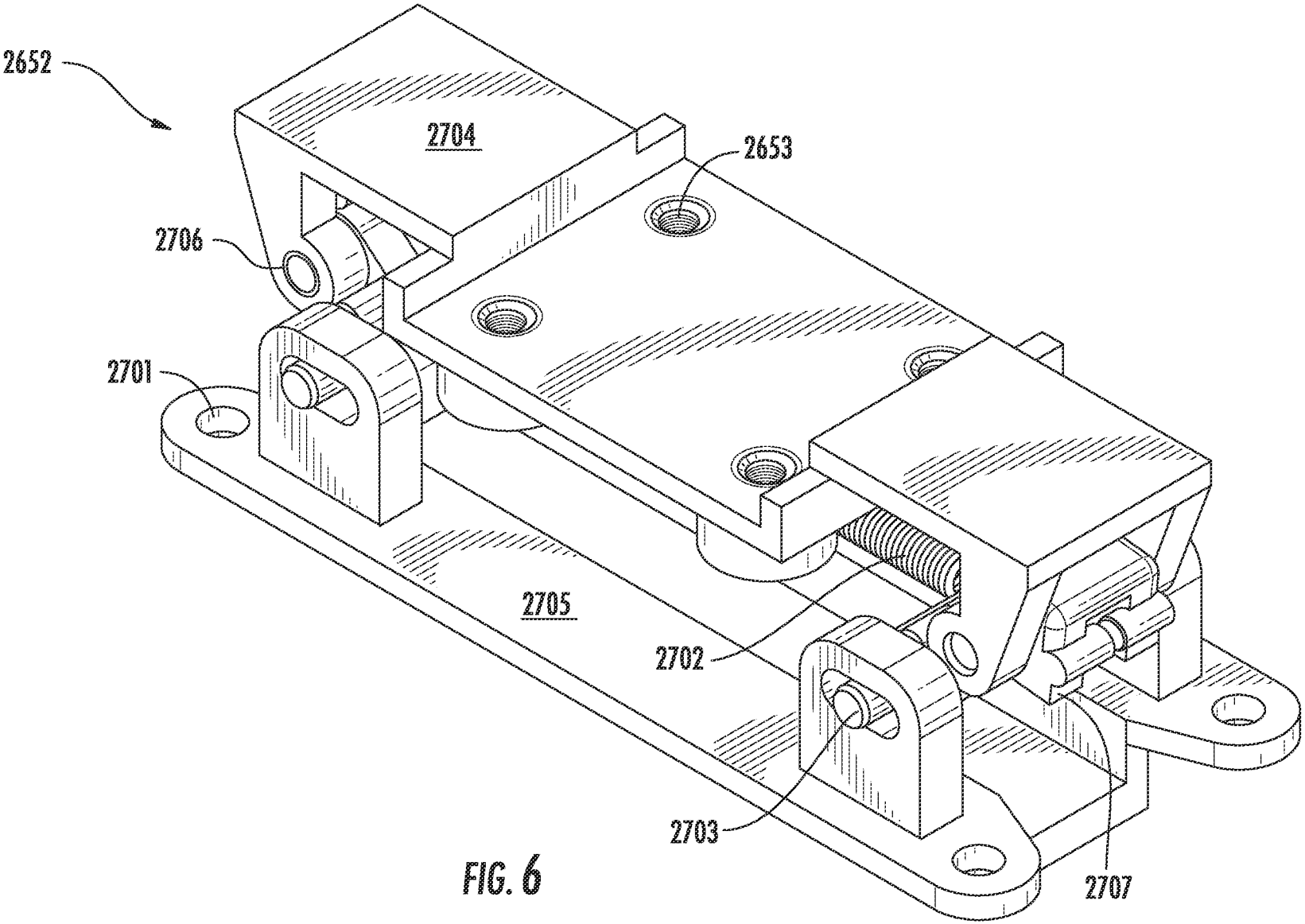
FIG. 6 is a perspective view of the lift mechanism shown in FIG. 4, consistent with embodiments of the present disclosure.
Figure 7:
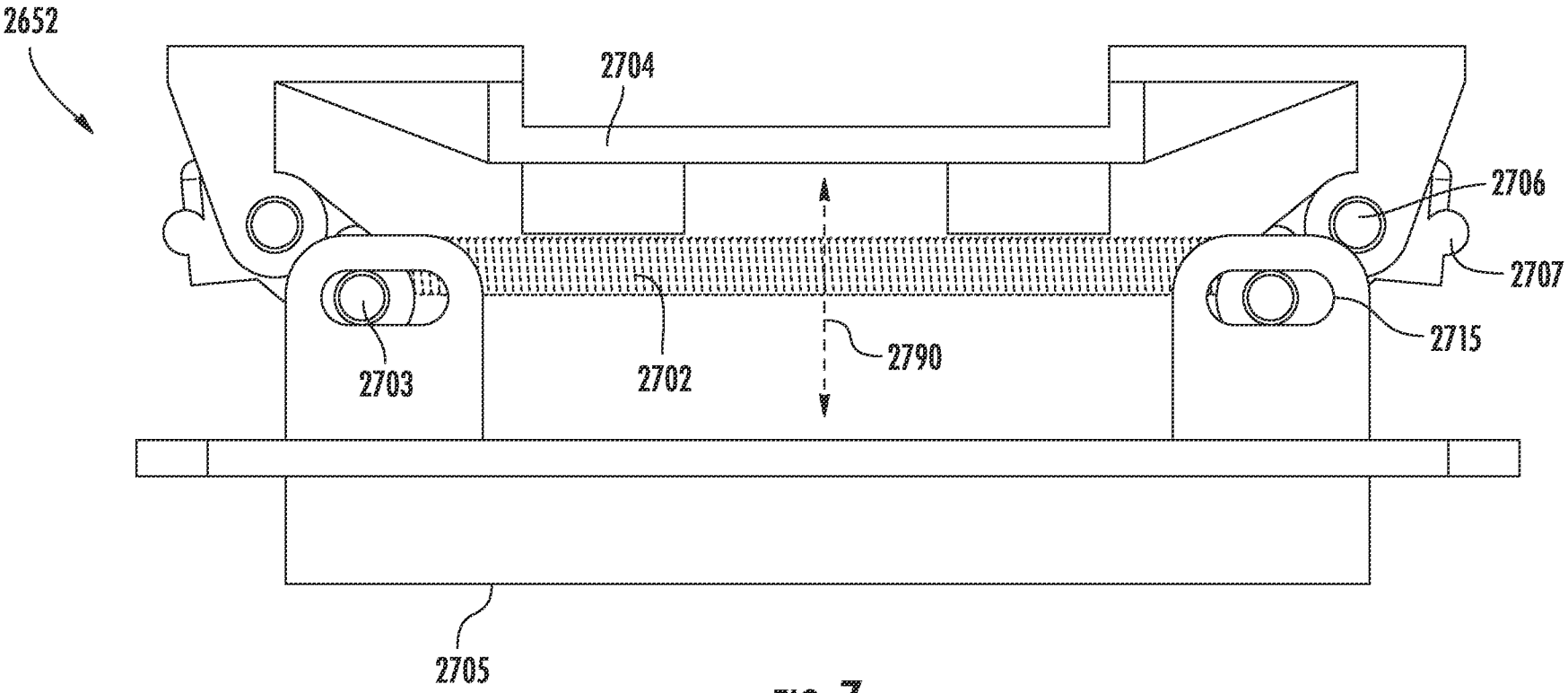
FIG. 7 is a side view of the lift mechanism shown in FIG. 4, consistent with embodiments of the present disclosure.
Figure 8:
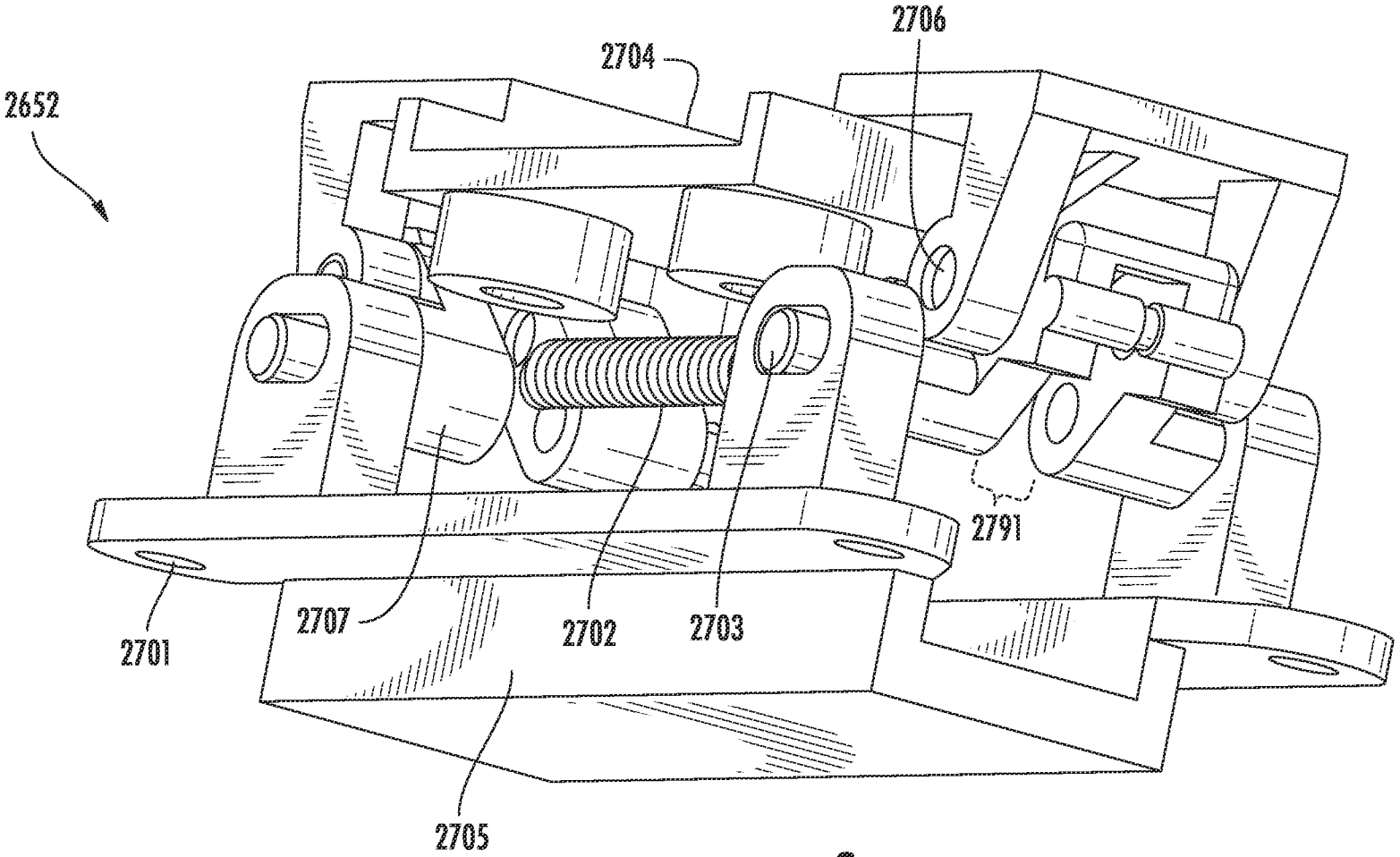
FIG. 8 is a bottom perspective view of the lift mechanism shown in FIG. 4, consistent with embodiments of the present disclosure.

As shown in FIGS. 6-8, the lift mechanism 2652 includes the plurality of cleaner attachment points 2653, a top plate 2704, a bottom plate 2705, a plurality of assembly attachment points 2701, lower pivot pins 2703, upper pivot pins 2706, a biasing mechanism (e.g., a spring) 2702, and a plurality of linkages 2707. The plurality of cleaner attachment points 2653 are configured to couple the lift mechanism 2652 to the chassis 2602 of the robotic cleaner 2600. As such, a top surface of the top plate 2704 of the lift mechanism 2652 faces a top surface of the robotic cleaner 2600. For example, the top plate 2704 may be substantially parallel to the top surface of the robotic cleaner 2600 (e.g., a top surface of the chassis 2602 of the robotic cleaner 2600).

The plurality of assembly attachment points 2701 are configured to couple the lift mechanism 2652 to the agitator assembly 2659 (e.g., the housing 2654 of the agitator assembly 2659). As such, the bottom plate 2705 of the lift mechanism 2652 moves along the assembly axis 2790 in response to the agitator assembly 2659 encountering changes in the surface to be cleaned. For example, the bottom plate 2705 can be configured to move in a direction of (or away from) the top plate 2704.

The bottom plate 2705 may be movably coupled to the top plate 2704. As shown, the bottom plate 2705 may be coupled to the top plate 2704 using the linkages 2707. The linkages 2707 may be pivotally coupled to the top plate 2704 and slidably coupled to the bottom plate 2705. As shown, the linkages 2707 include an upper pin 2706 and a lower pin 2703. The upper pin 2706 is pivotally coupled to the top plate 2704 and the lower pin 2703 is slidably coupled to the bottom plate 2705. In other words, a first end of the linkage 2707 is pivotally coupled to the top plate 2704 and a second end of the linkage 2707 is slidably coupled to the bottom plate 2705. As the linkages 2707 pivot the lower pins 2703 slide within a track 2715 defined in the bottom plate 2705.

When the bottom plate 2705 moves towards the top plate 2704, the linkages 2707 pivot towards each other. When the bottom plate 2705 moves away from the top plate 2704, the linkages 2707 pivot away from each other. The biasing mechanism 2702 can be configured to urge the linkages 2707 towards each other. As shown, the biasing mechanism 2702 can extend between the plurality of linkages 2707. For example, the biasing mechanism 2702 can be a tension spring that extends between opposing linkages 2707 such that the tension spring urges the linkages 2707 to pivot towards each other. In some instances, the biasing mechanism 2702 may extend substantially parallel to the top and/or bottom plates 2704 and/or 2705.

The biasing mechanism 2702 may be configured such that a force exerted by the biasing mechanism 2702 on the linkages 2707 is insufficient to lift the agitator assembly 2659 from the surface to be cleaned. Such a configuration may reduce an amount of force required to move the agitator assembly 2659 towards the chassis 2602. Such a configuration may also encourage the agitator assembly 2659 to maintain a consistent engagement with a surface to be cleaned while allowing the agitator assembly 2659 to adjust to surface changes more easily.

Figure 8A:
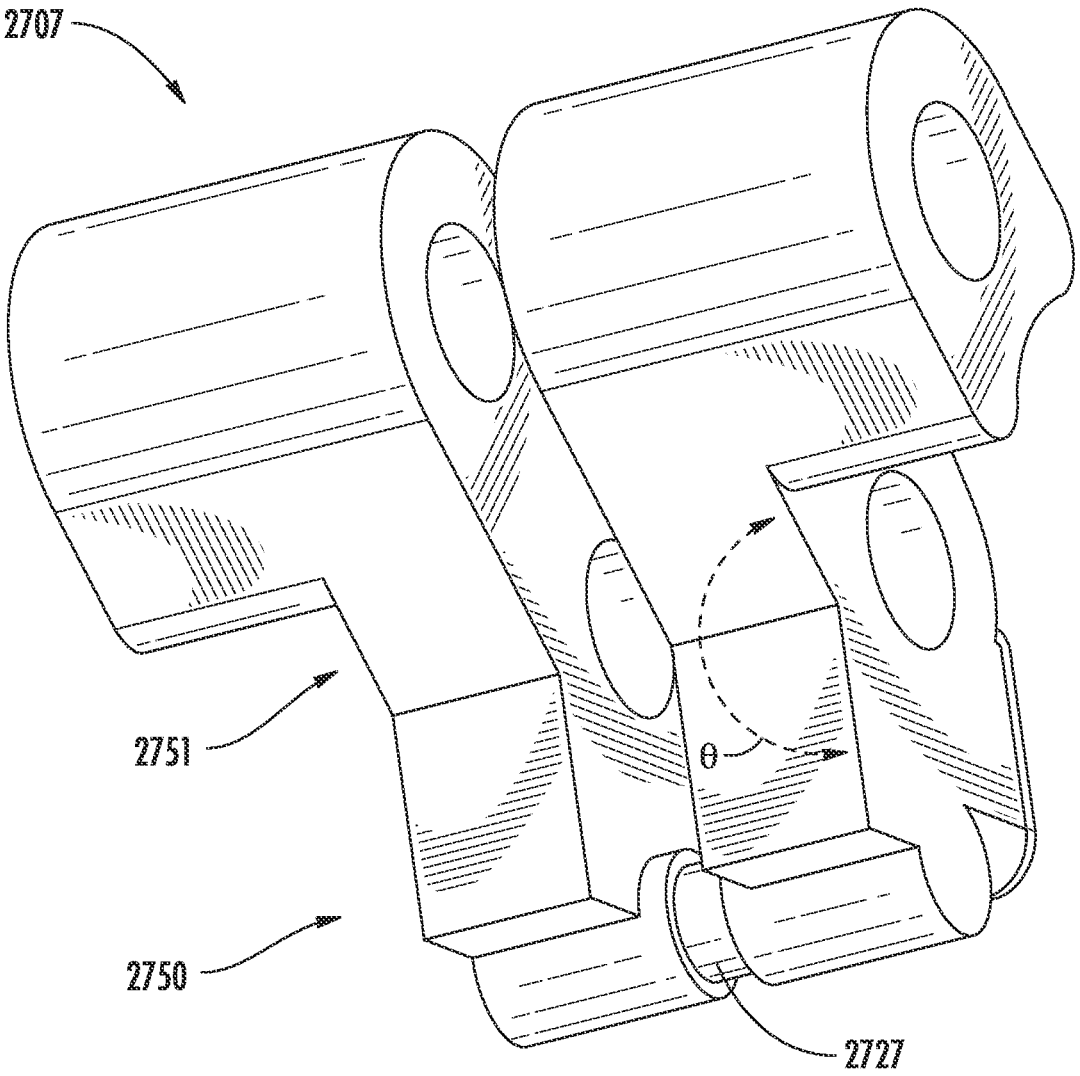
FIG. 8A is a perspective view of a linkage of the lift mechanism shown in FIG. 4, consistent with embodiments of the present disclosure.

As shown, the plurality of linkages 2707 can each define a recess 2791 configured to receive at least a portion of the biasing mechanism 2702. For example, each linkage 2707 may have a U-shape, wherein the recess 2791 is defined between opposing sides of the U-shaped linkage 2707. Each side of a U-shaped linkage 2707 may include a corresponding upper pin 2706 and lower pin 2703. The upper and lower pins 2706, 2703 may be coupled to (e.g., using one or more of an adhesive, a press-fit, a threaded coupling, and/or any other form of coupling) or formed from the linkages 2707. In some instances, the recess 2791 can include a coupling feature 2727 (see, e.g., FIG. 8A which shows an example of the linkage 2707, wherein the linkage 2707 of FIG. 8A is configured to form a press fit with the upper and lower pins 2706, 2703). The coupling feature 2727 can be configured to couple the biasing mechanism 2702 to the linkage 2707. In some instances, a central longitudinal axis of the biasing mechanism 2702 may intersect with both coupling features 2727. The recess 2791 may be configured such that the biasing mechanism 2702 does not engage (e.g., contact) one or more surfaces of the recess 2791. In some instances, the recess 2791 can be configured such that the biasing mechanism 2702 extends substantially parallel to the top and/or bottom plates 2704 and/or 2705.

In some instances, the linkage 2707 may have a non-linear shape. For example, and with reference to FIG. 8A, the linkage 2707 may include a first linear region 2750 and a second linear region 2751, wherein the first linear region 2750 extends transverse to the second linear region 2751 at a linkage angle θ. The linkage angle θ may measure, for example, in range of 100° and 150°. By way of further example, the linkage angle θ may measure 135°.

In some instances, a single motor 2651 is used to drive one or more agitators of the agitator assembly 2659. The weight of the motor 2651 may unbalance the agitator assembly 2659. As such, the biasing mechanism 2702 may be configured such that it offsets the uneven allotment of weight in the agitator assembly 2659 resulting from the positioning of the motor 2651.

The biasing mechanism 2702 may be any type of biasing mechanism. For example, the biasing mechanism 2702 may be a leaf spring, a torsion spring, an elastomeric material, and/or any other biasing mechanism.

While the bottom plate 2705 is shown as being separate from the housing 2654 of the agitator assembly 2659, the bottom plate 2705 may be integrally formed from the housing 2654. In this instance, the linkages 2707 may couple directly to the housing 2654.

Figure 9A:
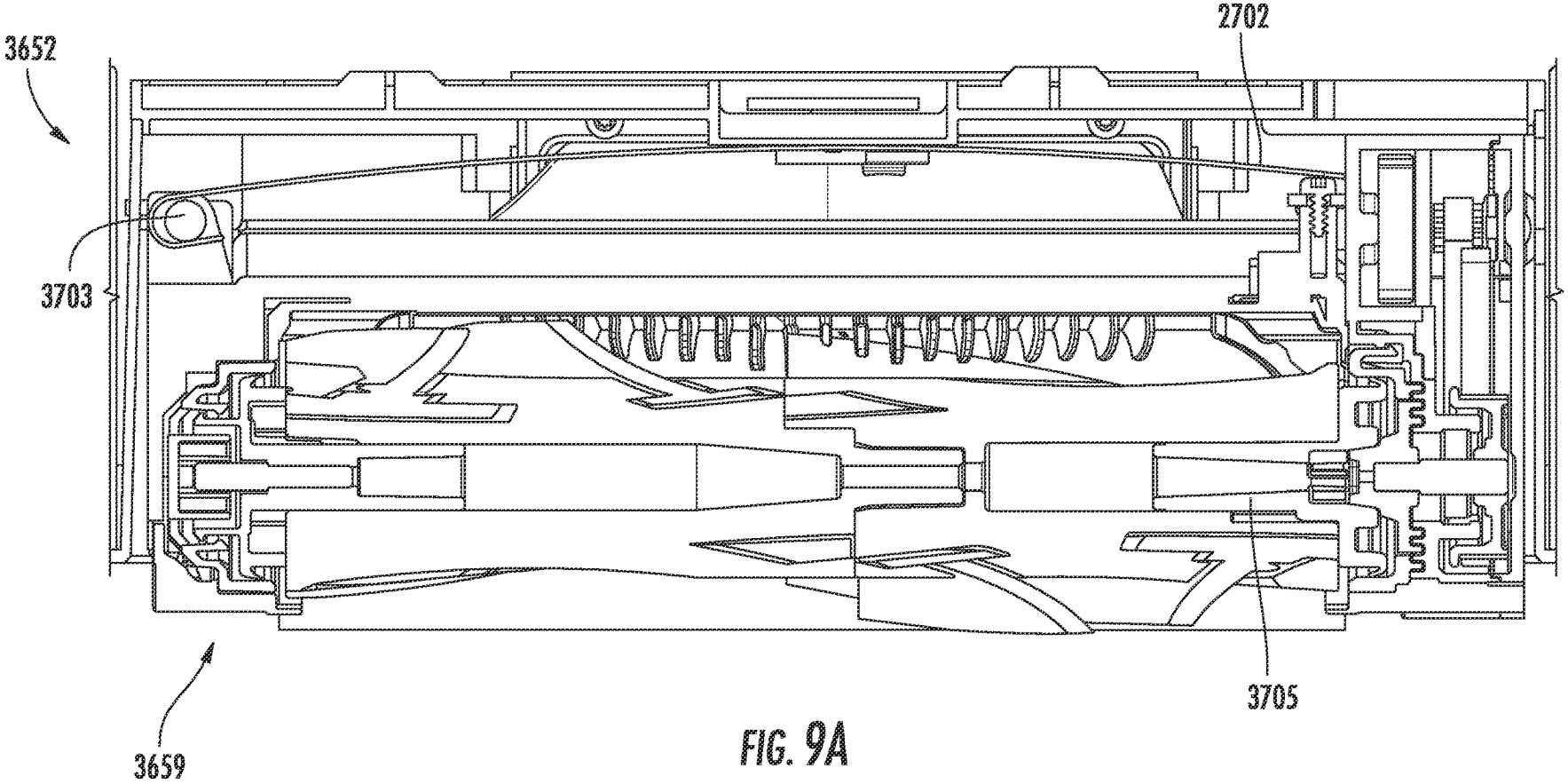
FIG. 9A is a cross-sectional view of an agitator assembly of a robotic cleaner, consistent with embodiments of the present disclosure.
Figure 9B:
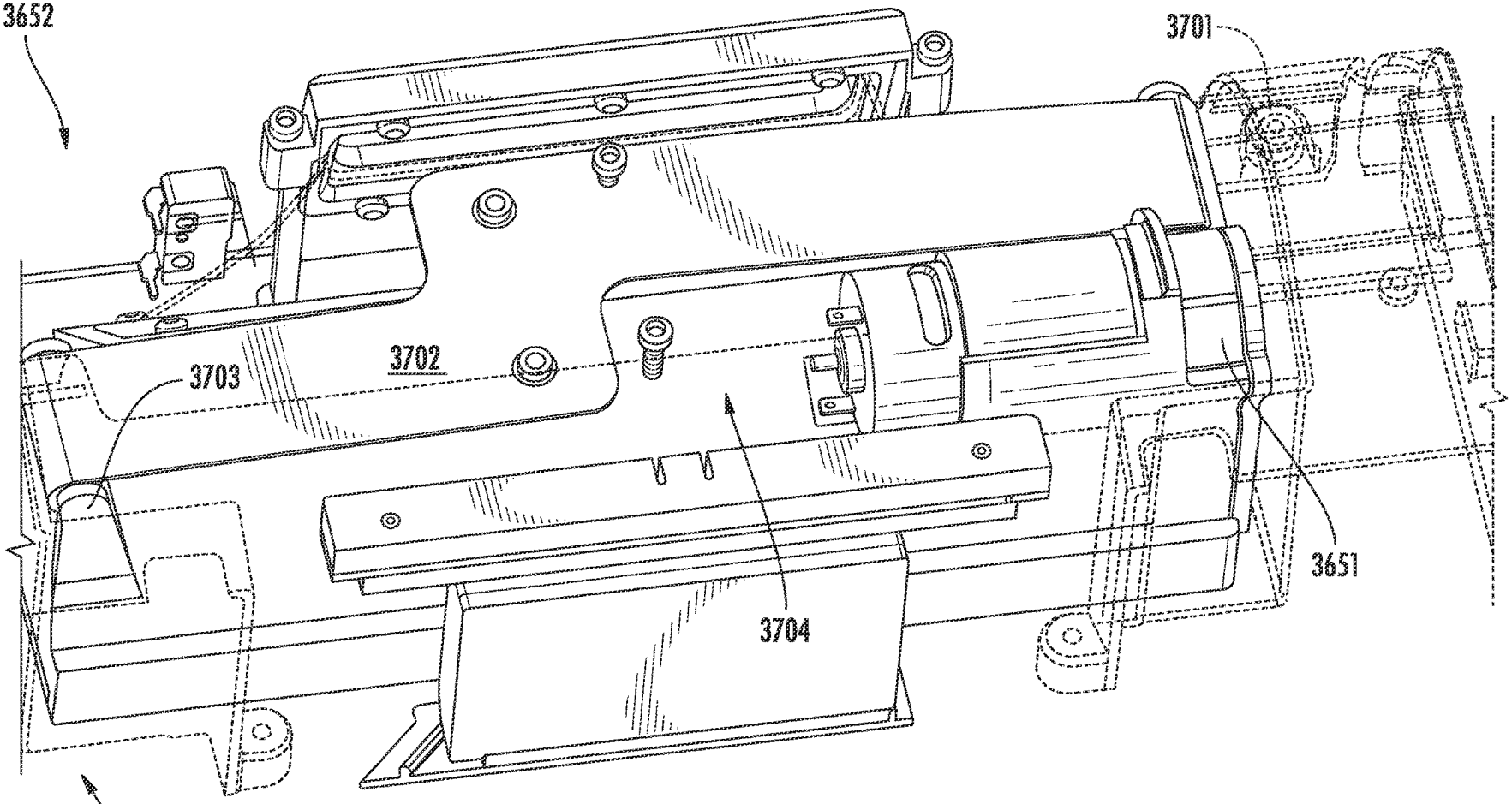
FIG. 9B is a top perspective view of the agitator assembly shown in FIG. 9A, consistent with embodiments of the present disclosure.
Figure 10:
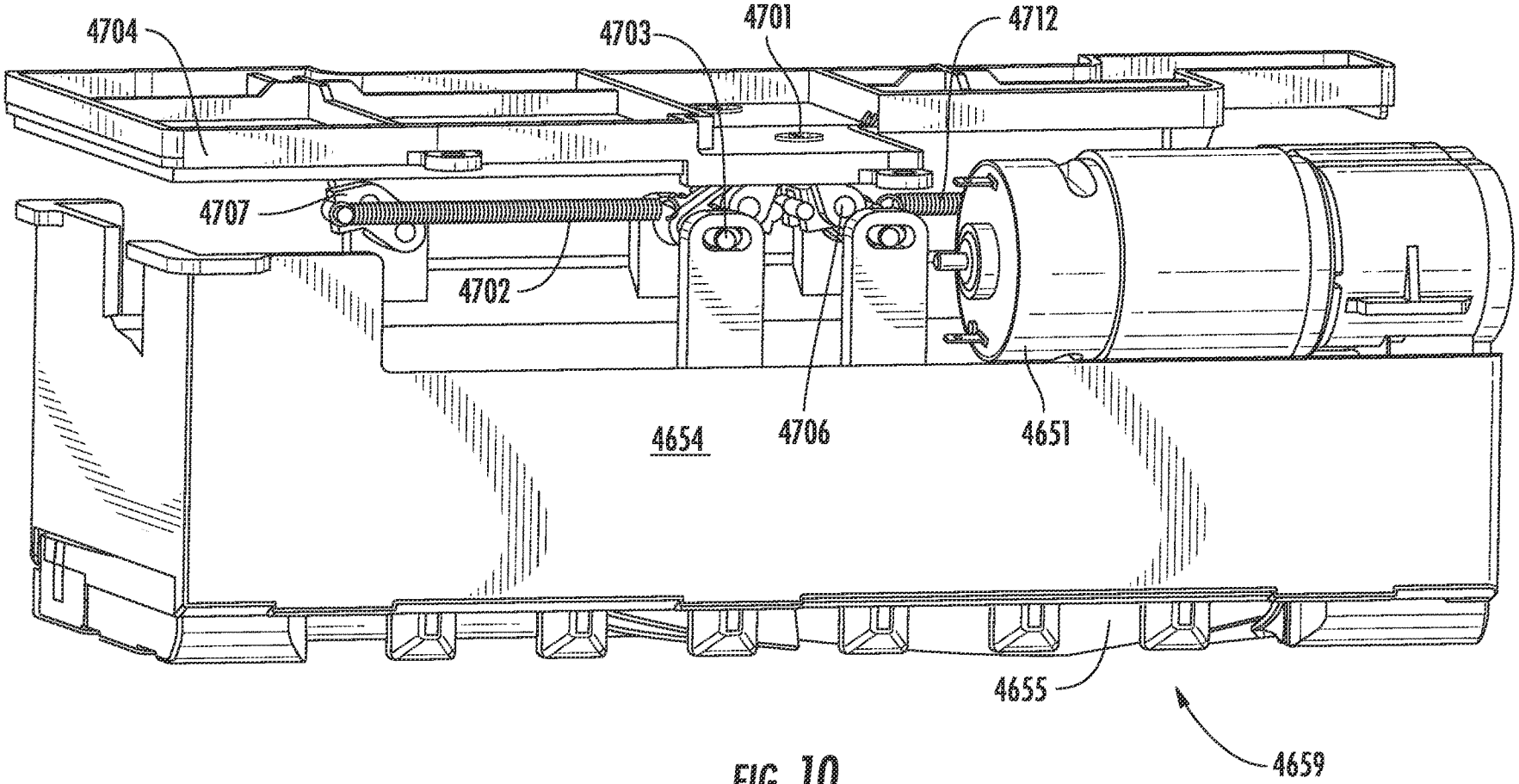
FIG. 10 is a perspective view of an agitator assembly of a robotic cleaner, consistent with embodiments of the present disclosure.
Figure 77:
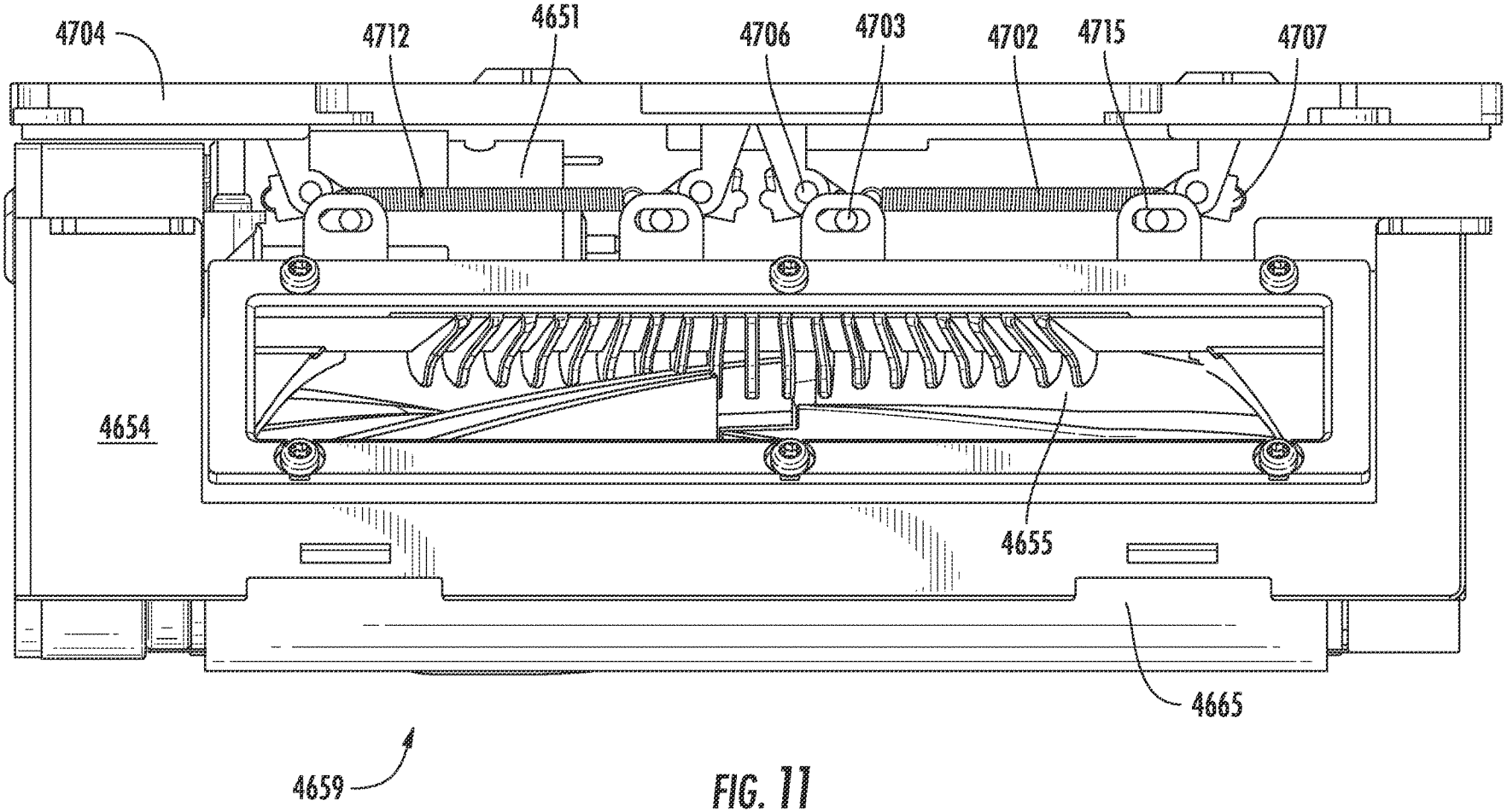
Figure 12:
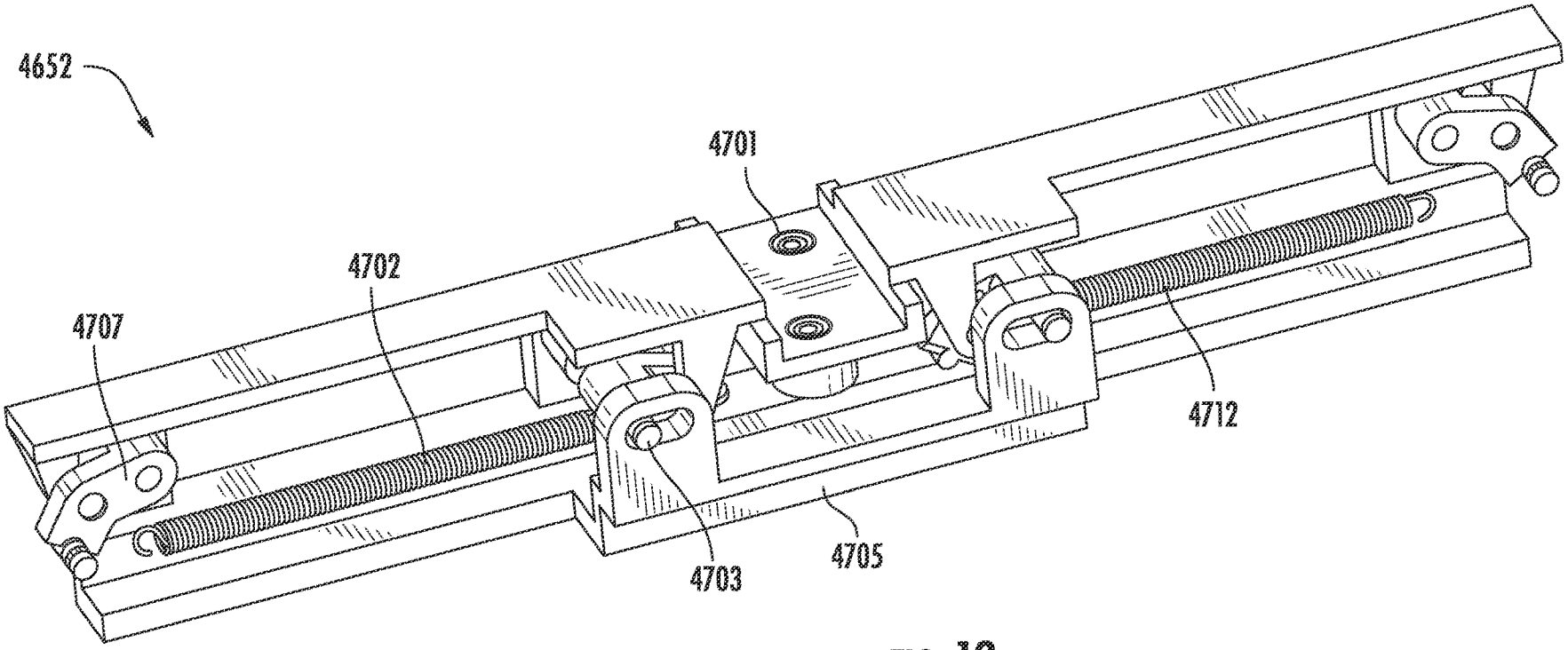
FIG. 12 is a perspective view of the lift mechanism shown in FIG. 10, consistent with embodiments of the present disclosure.
Figure 13A:
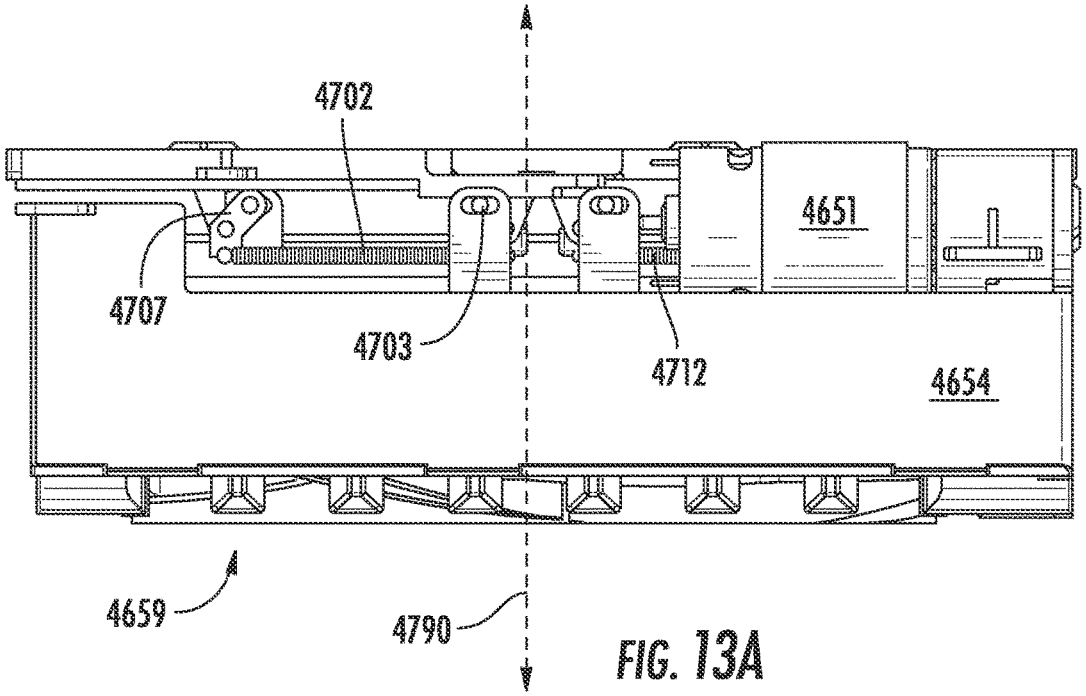
FIG. 13A is a front view of the agitator assembly of FIG. 1 in a retracted position, consistent with embodiments of the present disclosure.
Figure 13B:
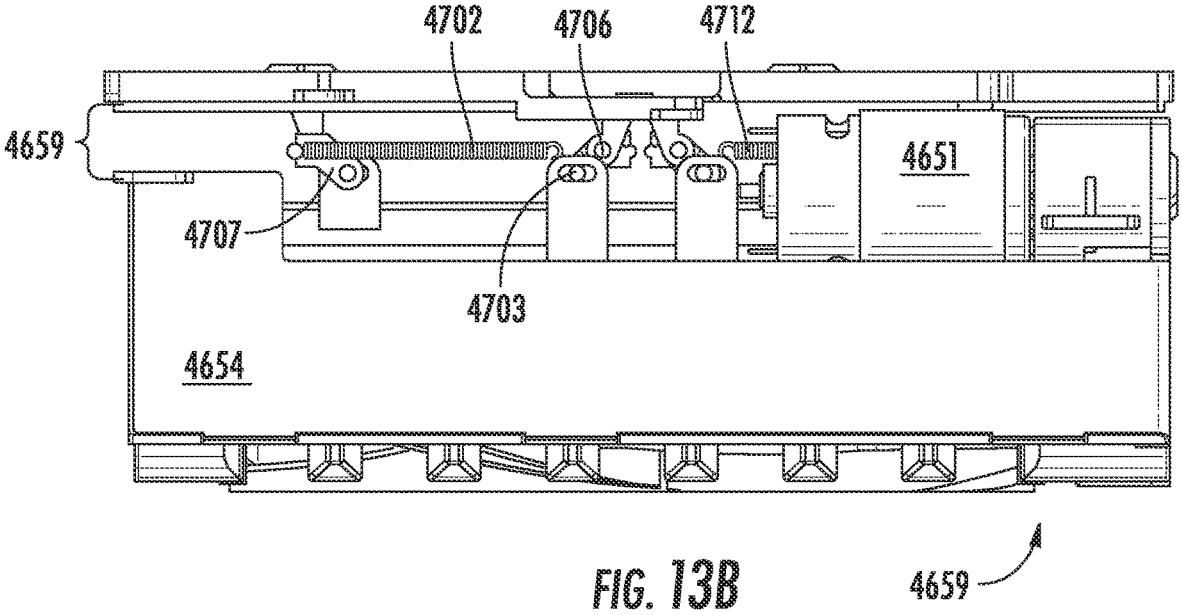
FIG. 13B is a front view of the agitator assembly of FIG. 10 in an extended position, consistent with embodiments of the present disclosure.
Figure 14:
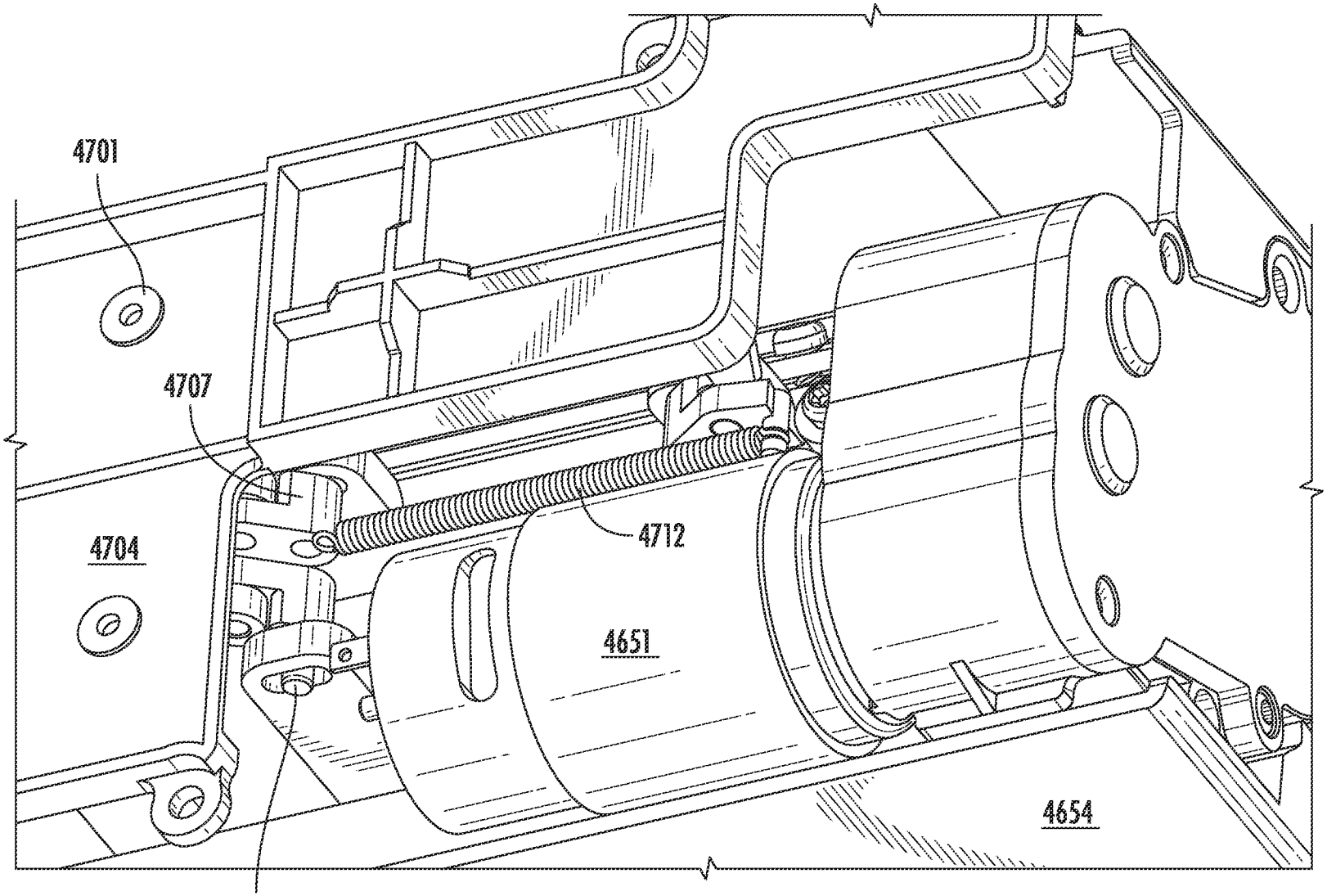
FIG. 14 is a perspective top view of a portion of the agitator assembly of FIG. 10, consistent with embodiments of the present disclosure.
Figure 15:
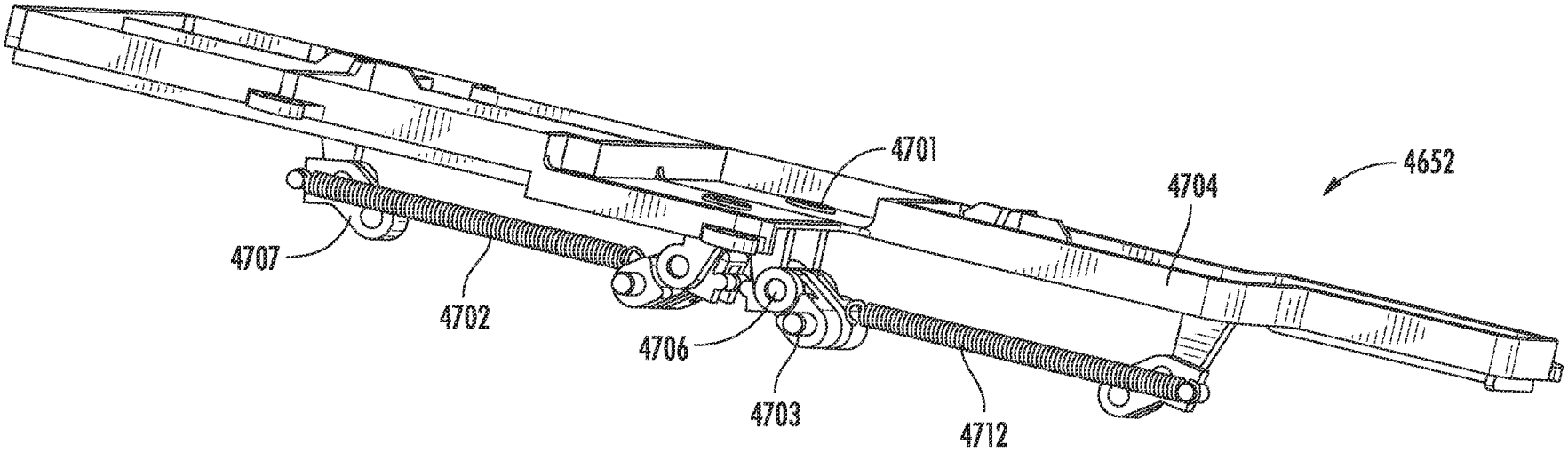
FIG. 15 is a perspective view of a portion of the lift mechanism shown in FIG. 10, consistent with embodiments of the present disclosure.
Figure 16:
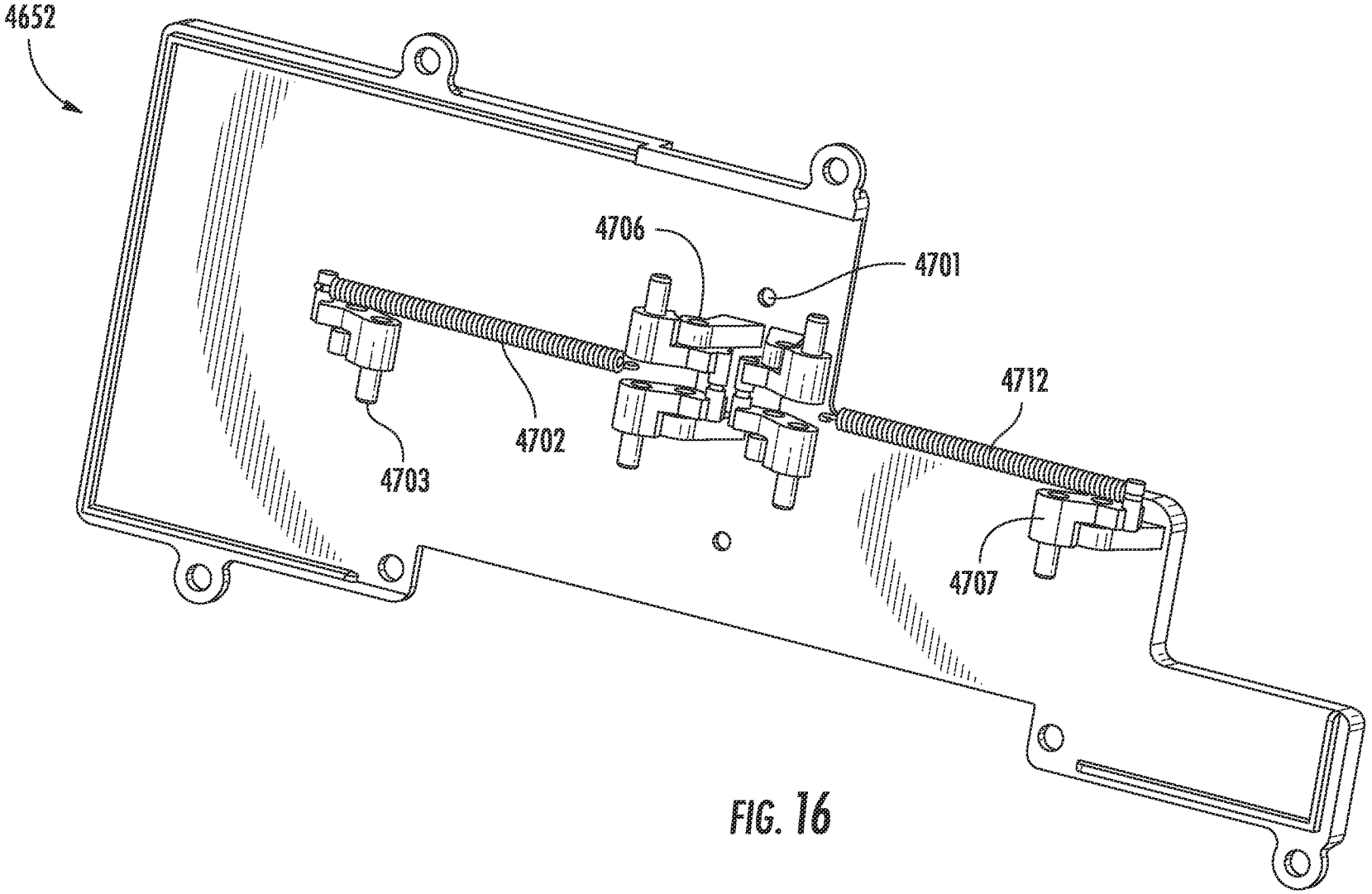
FIG. 16 is a perspective bottom view of a portion of the lift mechanism shown in FIG. 10, consistent with embodiments of the present disclosure.

FIGS. 9A and 9B show an example of a lift mechanism 3652 having a leaf spring 3702 that is configured to urge an agitator assembly 3659 in a direction away from a chassis 3701 of a robotic cleaner. Such a configuration may offset at least a portion of a downward force resulting from the weight of the agitator assembly 3659.

As shown, the leaf spring 3702 couples to spring mounting points 3703 of the agitator assembly 3659. The leaf spring 3702 may have an arcuate shape, wherein a concave surface of the leaf spring 3702 faces the agitator assembly 3659. As shown in FIG. 9B, the leaf spring 3702 may have a non-linear shape. For example, the leaf spring 3702 may define a stepped region 3704 to accommodate a motor 3651 of the agitator assembly 3659, the motor 3651 being configured to drive at least one agitator 3705 of the agitator assembly 3659.

FIGS. 10-16 show an example of an agitator assembly 4659 coupled to a lift mechanism 4652. The agitator assembly 4659 is configured to be carried by a robotic cleaner (not shown). For example, the agitator assembly 4659 can be configured to couple to a chassis of the robotic cleaner. As shown, the agitator assembly 4659 includes a housing 4654, a motor 2651, a first agitator 4655, and a second agitator 4665. The lift mechanism 4652 is configured to couple to the agitator assembly 4659 using a plurality of attachment points and to be further coupled to a chassis of the robotic cleaner. The lift mechanism 4652 is further configured such that the agitator assembly 4659 can move between an extended position and a retracted position in response to changes in a surface to be cleaned. In other words, the lift mechanism 4652 is configured such that the agitator assembly 4659 moves (e.g., vertically) relative to the chassis of the robotic cleaner (e.g., towards or away from a top portion of the chassis). As such, the agitator assembly 4659 may operate as a floating sole plate. In some instances, the lift mechanism 4652 may include a first and a second biasing mechanism 4702, 4712 configured to urge the agitator assembly 4659 towards the retracted position, wherein a force exerted by the biasing mechanisms 4702, 4712 is insufficient to lift the agitator assembly 4659 from the surface to be cleaned.

The agitator assembly 4659 forms a suction conduit (or air inlet) that is fluidly coupled to a dust cup and a suction motor. The suction motor causes air to flow along an air flow path that passes through the suction conduit, into the dust cup, and through the suction motor. The air flowing along the airflow path may have debris entrained therein. At least a portion of the entrained debris may be deposited in the dust cup for later disposal.

The agitator assembly 4659 is configured to move between an extended position and a retracted position. When the agitator assembly 4659 is in the extended position, the lift mechanism 4652 is fully extended (e.g., the lift mechanism 4652 may fully extend in response to the robotic cleaner being lifted from the surface to be cleaned), preventing further movement of the agitator assembly 4659 in a direction away from the chassis of the robotic cleaner. When the agitator assembly 4659 is in the retracted position, the lift mechanism 4652 cannot retract any further, preventing further movement of the agitator assembly 4659 in a direction towards the chassis of the robotic cleaner. During operation, the agitator assembly 4659 moves between at least two intermediary positions, the intermediary positions being between the extended position and the retracted position.

The maximum extension and retraction of the lift mechanism 4652 may be limited by one or more stops (e.g., defined by or coupled to the chassis of the robotic cleaner). The one or more stops can be configured to engage the agitator assembly 4659, preventing additional extension or retraction of the lift mechanism 4652. The position of the lift mechanism 4652 when the agitator assembly 4659 is engaging a respective stop may generally be described as the position where the lift mechanism 4652 is fully extended or fully retracted. The one or more stops may be further configured to dampen any sound generated as a result of the agitator assembly 4659 engaging the one or more stops (e.g., the stops may include a rubber or compressible foam).

The surface on which the robotic cleaner travels may displace the agitator assembly 2659 from the extended position such that the agitator assembly 4659 moves towards the retracted position and, at least partially, into the robotic cleaner chassis. For example, while the robotic cleaner traverses the surface to be cleaned, the agitator assembly 4659 may move along an assembly axis 4790 (e.g., a vertical axis). Carpet, hard wood, tile, rugs, and other flooring types may have different features that influence a magnitude of the displacement of the agitator assembly 4659. The displacement of the agitator assembly 4659 along the assembly axis 4790 may, for example, measure in a range of 7 millimeters (mm) to 11 mm. By way of further example, the displacement of the agitator assembly 4659 along the assembly axis 4790 may measure in a range of 4 mm to 10 mm. By way of still further example, the displacement of the agitator assembly 4659 along the assembly axis 4790 may measure 7 mm. The total displacement of the agitator assembly 4659 may allow the robotic cleaner to operate effectively on multiple types of surfaces.

During operation, a lower planar surface of the agitator assembly 4659 extends substantially (e.g., within 1°, 2°, 3°, 4°, or 5° of) parallel to the surface to be cleaned. The distance between the agitator assembly 4659 and the surface to be cleaned may influence a suction force generated at the suction conduit of the agitator assembly 4659. The distance between the agitator assembly 4659 and the surface to be cleaned may further influence an amount of engagement between the agitator of the agitator assembly and the surface to be cleaned. For example, when transitioning from a high pile carpet to a hardwood floor the agitator assembly may move towards the hardwood floor, encouraging a consistent engagement between the agitator and the surface to be cleaned. When compared to a fixed agitator assembly, movement of the agitator assembly 4659 towards the hardwood floor may increase agitation of the surface, encouraging additional dry debris to be suctioned into the dust cup.

A weight of the agitator assembly 4659 may interfere with a movement of the agitator assembly 4659 in response to changes in the surface to be cleaned. As such, in some instances, the lift mechanism 4652 can be configured to offset at least a portion of the weight of the agitator assembly 4659. For example, the lift mechanism 4652 may include a biasing mechanism (e.g., a spring) configured to urge the lift mechanism 4652 towards the retracted position, wherein a force exerted by the biasing mechanism is insufficient to cause the agitator assembly 4659 to move towards the chassis of the robotic cleaner. Offsetting at least a portion of the weight of the agitator assembly 4659 using the lift mechanism 4652 may encourage better engagement between the agitator assembly 4659 and the surface to be cleaned. If the agitator assembly 4659 is not sufficiently displaced, power consumption may be increased when the robotic cleaner moves over some surfaces. Additional power consumption on surfaces such as carpet may prevent the robotic cleaner from effectively completing tasks. For example, a distance of approximately 1 mm may extend between the agitator assembly 4659 (e.g., a bottom most portion of the agitator assembly 4659) and the surface to be cleaned. Such a configuration may cause sufficient suction to be generated such that debris is removed from the surface to be cleaned while minimizing power consumption.

As shown, the lift mechanism 4652 includes the plurality of cleaner attachment points, a top plate 4704, a bottom plate 4705, a plurality of assembly attachment points 4701, lower pivot pins 4703, upper pivot pins 4706, a first and second biasing mechanism (e.g., a spring) 4702, 4712, and a plurality of linkages 4707. The plurality of cleaner attachment points are configured to couple the lift mechanism 4652 to the chassis of the robotic cleaner. As such, a top surface of the top plate 4704 of the lift mechanism 4652 faces a top surface of the robotic cleaner. For example, the top plate 4704 may be substantially parallel to the top surface of the robotic cleaner (e.g., a top surface of the chassis of the robotic cleaner).

The plurality of assembly attachment points 4701 are configured to couple the lift mechanism 4652 to the agitator assembly 4659 (e.g., the housing 4654 of the agitator assembly 4659). As such, the bottom plate 4705 of the lift mechanism 4652 moves along the assembly axis 4790 in response to the agitator assembly 4659 encountering changes in the surface to be cleaned. For example, the bottom plate 4705 can be configured to move in a direction of (or away from) the top plate 4704.

The bottom plate 4705 may be movably coupled to the top plate 4704. As shown, the bottom plate 4705 may be coupled to the top plate 4704 using the linkages 4707. The linkages 4707 may be pivotally coupled to the top plate 4704 and slidably coupled to the bottom plate 4705. As shown, the linkages 4707 include an upper pin 4706 and a lower pin 4703. The upper pin 4706 is pivotally coupled to the top plate 4704 and the lower pin 4703 is slidably coupled to the bottom plate 4705. In other words, a first end of the linkage 4707 is pivotally coupled to the top plate 4704 and a second end of the linkage 4707 is slidably coupled to the bottom plate 4705. As the linkages 4707 pivot the lower pins 4703 slide within a track 4715 defined in the bottom plate 4705. The upper and lower pins 4706, 4703 may be coupled to (e.g., using one or more of an adhesive, a press-fit, a threaded coupling, and/or any other form of coupling) or formed from the linkages 4707.

When the bottom plate 4705 moves towards the top plate 4704, the linkages 4707 pivot towards each other. When the bottom plate 4705 moves away from the top plate 4704, the linkages 4707 pivot away from each other. The biasing mechanisms 4702, 4712 can be configured to urge the linkages 4707 towards each other. As shown, the biasing mechanisms 4702, 4712 can extend between the plurality of linkages 4707. For example, the biasing mechanisms 4702, 4712 can be a tension spring that extends between opposing linkages 4707 such that the tension spring urges the opposing linkages 4707 to pivot towards each other. In some instances, the biasing mechanisms 4702, 4712 may extend substantially parallel to the top and/or bottom plates 4704 and/or 4705.

The biasing mechanisms 4702, 4712 may be configured such that a force exerted by the biasing mechanisms 4702, 4712 on the linkages 4707 is insufficient to lift the agitator assembly 4659 from the surface to be cleaned. Such a configuration may reduce an amount of force required to move the agitator assembly 4659 towards the chassis of the robotic cleaner. Such a configuration may encourage the agitator assembly 4659 to maintain a consistent engagement with a surface to be cleaned while allowing the agitator assembly 4659 to adjust to surface changes more easily.

In some instances, a single motor 4651 is used to drive one or more agitators of the agitator assembly 4659. The weight of the motor 4651 may unbalance the agitator assembly 4659. As such, the biasing mechanisms 4702, 4712 may be configured such that the biasing mechanisms 4702, 4712 offset the uneven allotment of weight in the agitator assembly 4659 resulting from the positioning of the motor 4651. For example, the biasing mechanism 4712 proximate the motor 4651 may be configured to exert a greater biasing force than the biasing mechanism 4702. Such a configuration may result in the biasing mechanism 4712 at least partially offsetting the weight of the motor 4651, encouraging the agitator assembly 4659 to be balanced.

The biasing mechanisms 4702, 4712 may be any type of biasing mechanism. For example, the biasing mechanisms 4702, 4712 may be a leaf spring, a torsion spring, an elastomeric material, and/or any other biasing mechanism.

While the bottom plate 4705 is shown as being separate from the housing 4654 of the agitator assembly 4659, the bottom plate 4705 may be integrally formed from the housing 4654. In this instance, the linkages 4707 may couple directly to the housing 4654.

Figure 17:
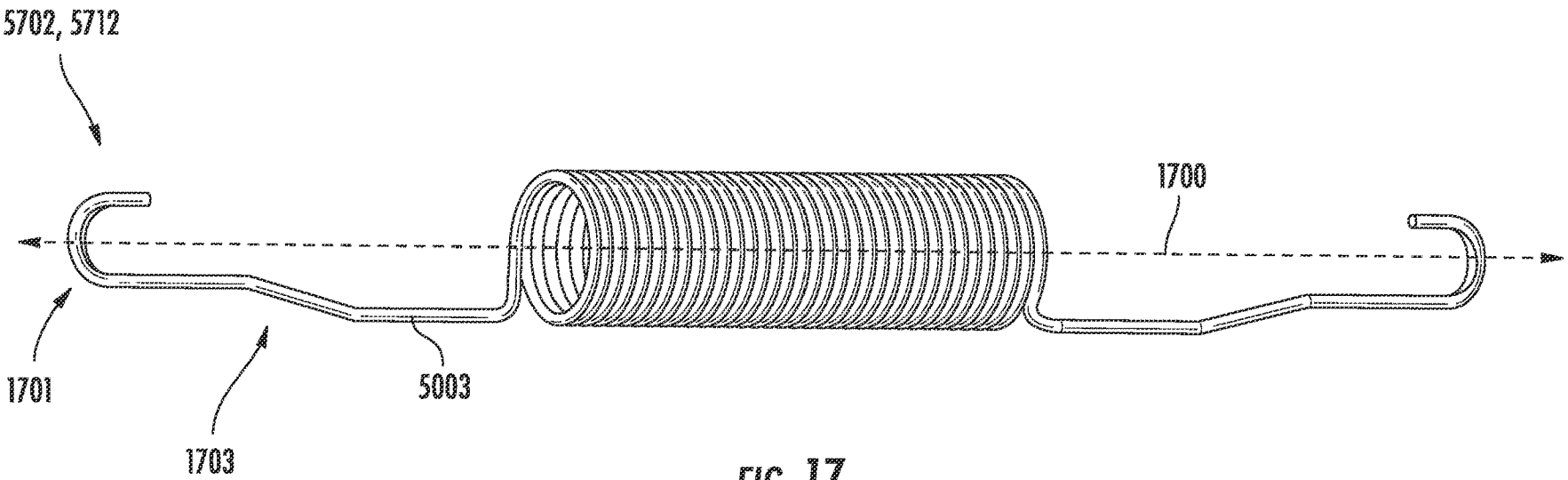
FIG. 17 is a perspective view of a spring of a lift mechanism of a robotic cleaner, consistent with embodiments of the present disclosure.
Figure 18:
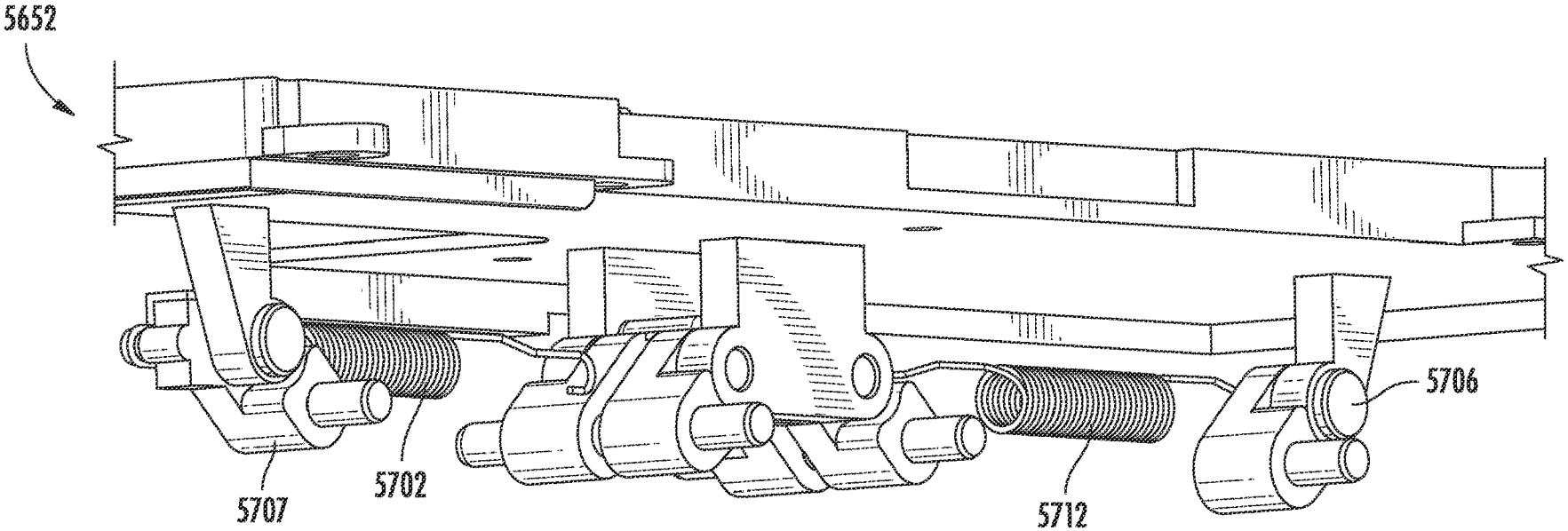
FIG. 18 is a perspective view of a portion of a lift mechanism incorporating the spring shown in FIG. 17, consistent with embodiments of the present disclosure.
Figure 19:
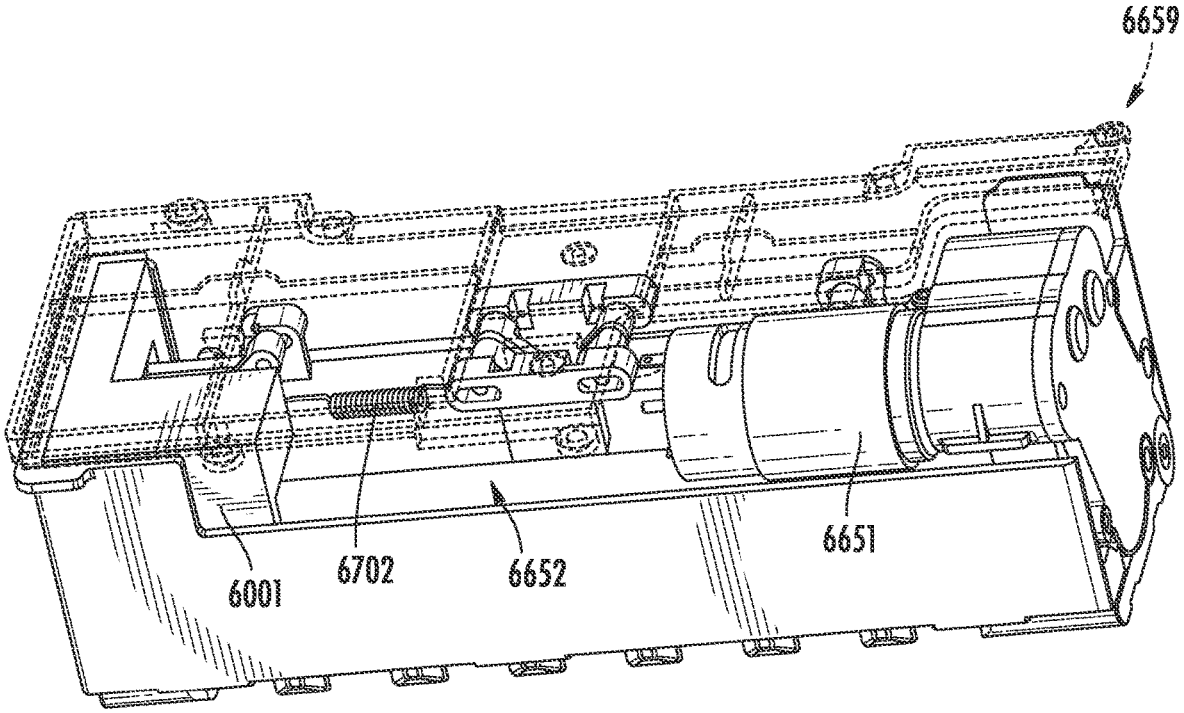
FIG. 19 is a perspective view of an agitator assembly of a robotic cleaner, consistent with embodiments of the present disclosure
Figure 20:
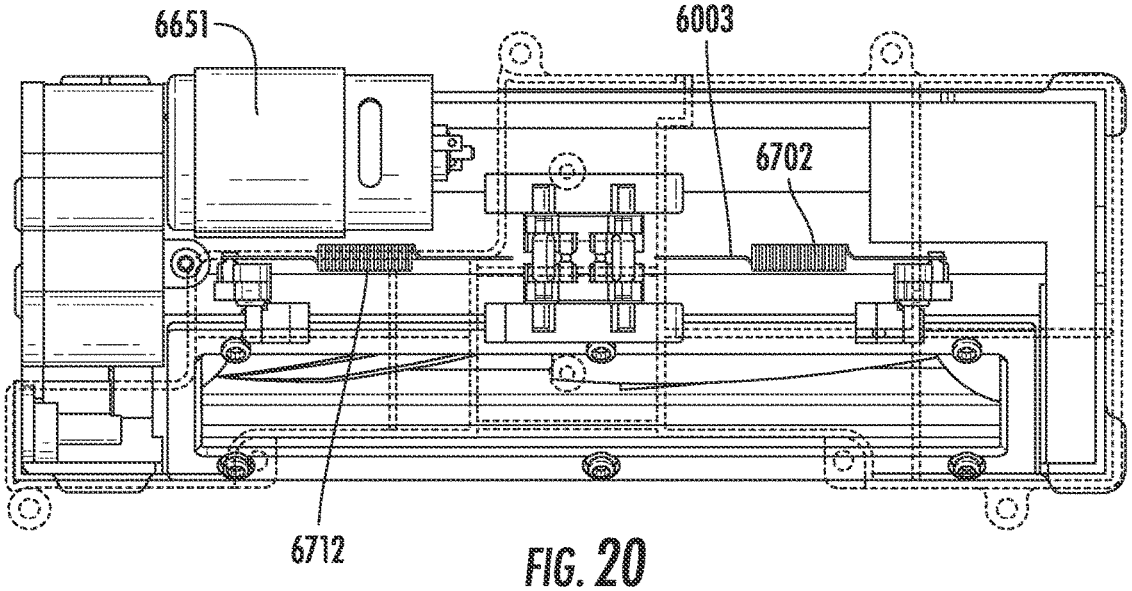
FIG. 20 is a top view of the agitator assembly shown in FIG. 19, consistent with embodiments of the present disclosure.
Figure 21A:
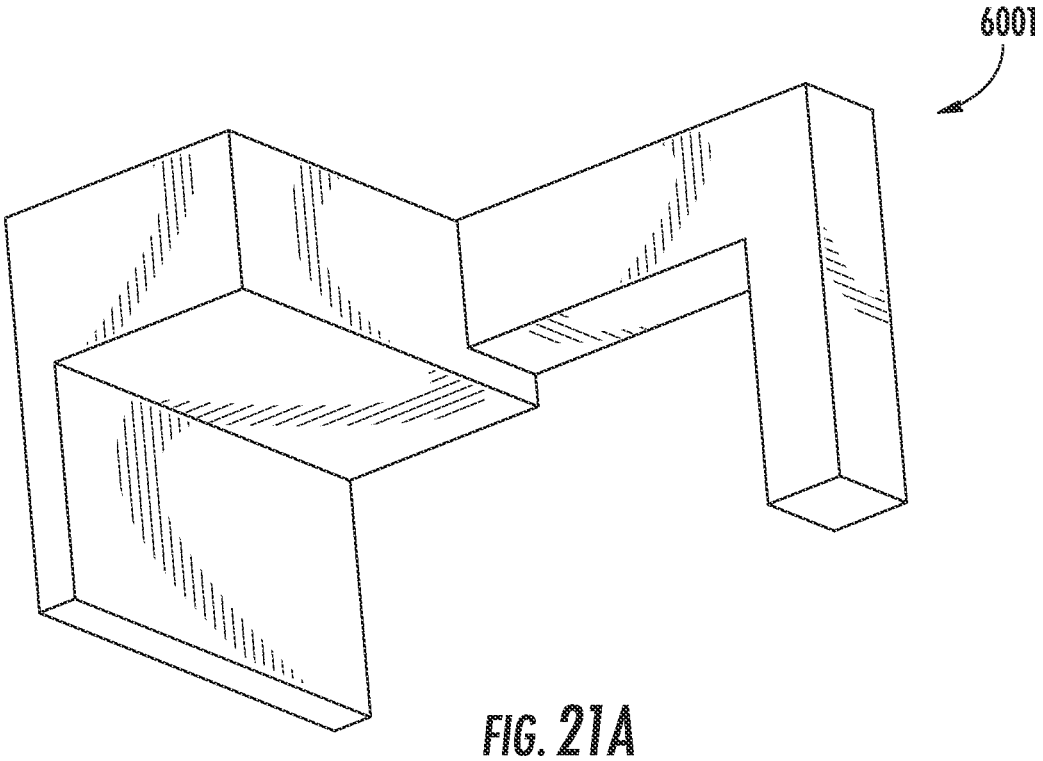
FIG. 21A is a bottom perspective view of a counterweight of the agitator assembly shown in FIG. 19, consistent with embodiments of the present disclosure.
Figure 21B:
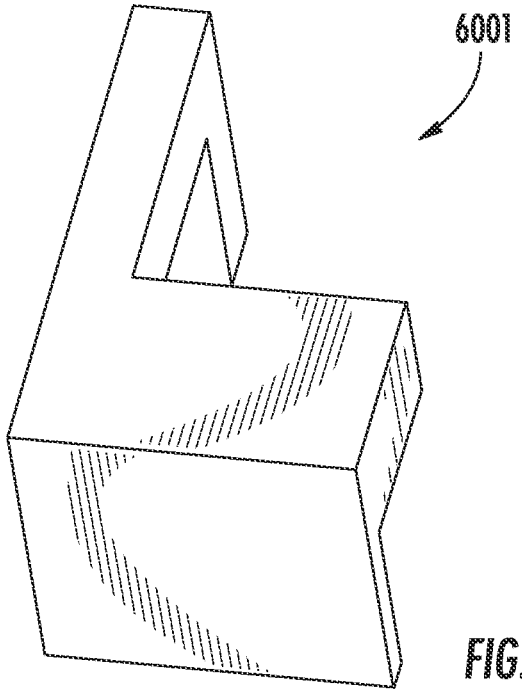
FIG. 21B is a perspective view of a counterweight of the agitator assembly shown in FIG. 19, consistent with embodiments of the present disclosure.

As shown in FIGS. 17 and 18, a lift mechanism 5652 may use a plurality of springs 5702, 5712 that include one or more extended arms 5003. The plurality of springs 5702, 5712 may be attached to a plurality of linkages 5707 using one or more headed pins 5706. The one or more extended arms 5003 allow the plurality of springs 5702, 5712 to be shaped (e.g., by including one or more transition regions 1703) to avoid other portions of an agitator assembly. As shown in FIG. 17, a central longitudinal axis 1700 of the springs 5702, 5712 may extend through both connection ends 1701 of the extend arms 5003.

As shown in FIGS. 19-21B, a counterweight 6001 may be coupled to an agitator assembly 6659. As described herein, in some instances, a single motor 6651 is used to drive one or more agitators. The weight of the motor 6651 may unbalance the agitator assembly 6659. The counterweight 6001 may be constructed such that it offsets the uneven allotment of weight in the agitator assembly 6659. A lift mechanism 6652 may use a plurality of springs 6702, 6712 that include one or more extended arms 6003. The one or more extended arms 6003 allow the plurality of springs 6702, 6712 to be shaped to avoid the counterweight 6001 and the motor 6651.

Figure 22:
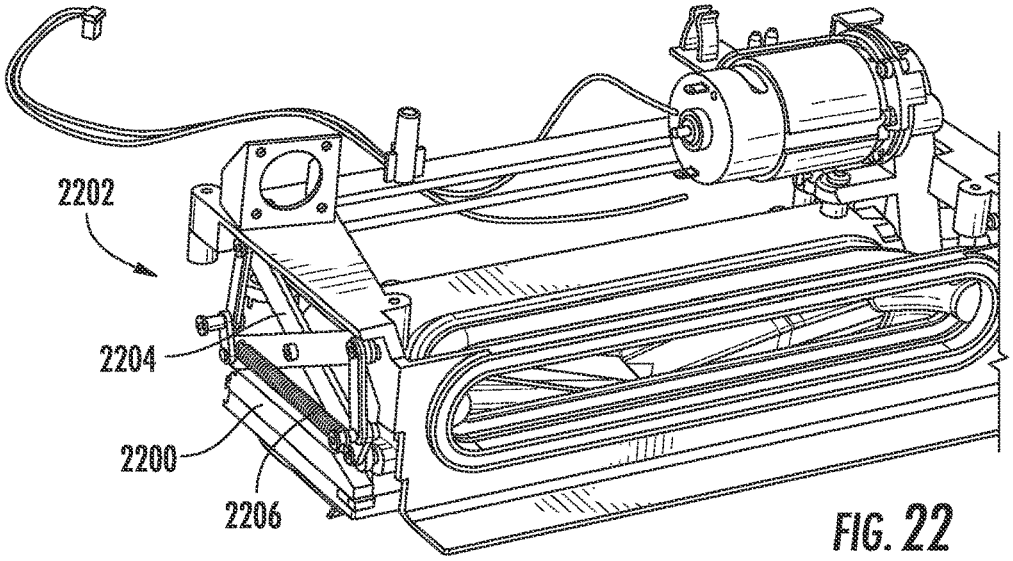
FIG. 22 is a perspective view of a lift mechanism coupled to an agitator assembly, consistent with embodiments of the present disclosure.
Figure 23:
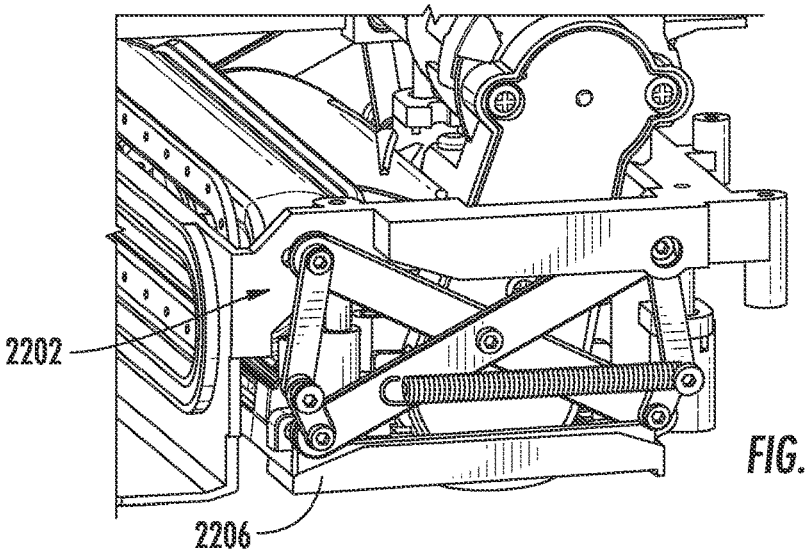
FIG. 23 is a perspective view of a portion of the lift mechanism of FIG. 22, wherein the lift mechanism is in an extended position, consistent with embodiments of the present disclosure.
Figure 24:
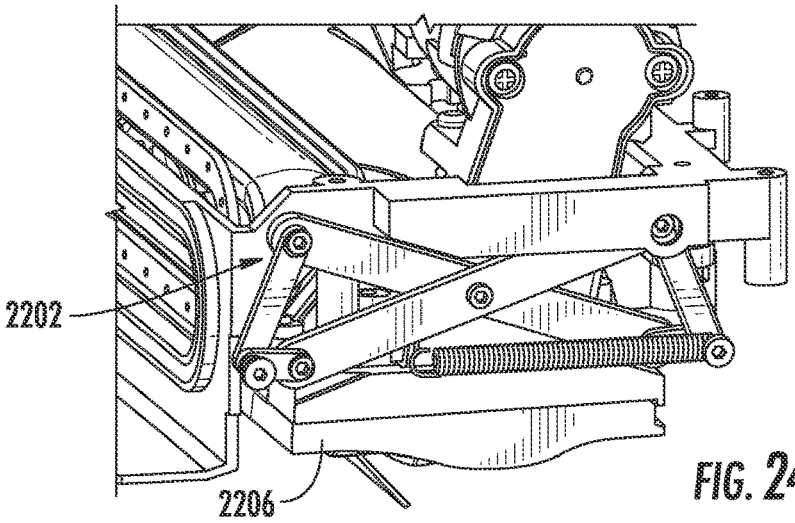
FIG. 24 is a perspective view of a portion of the lift mechanism of FIG. 22, wherein the lift mechanism is in a retracted position, consistent with embodiments of the present disclosure.

FIG. 22 shows an example of an agitator assembly 2200 coupled to a lift mechanism 2202. The lift mechanism 2202 is configured to couple to a robotic cleaner (e.g., a chassis of the robotic cleaner), wherein the lift mechanism 2202 is further configured such that the agitator assembly 2200 moves relative to the chassis of the robotic cleaner in response to changes in the surface to be cleaned. For example, the lift mechanism 2202 may be configured such that the agitator assembly 2200 can move between an extended position (as shown in FIG. 23) and a retracted position (as shown in FIG. 24). As shown, the lift mechanism 2202 includes a plurality of linkages 2204 that collectively define one or more scissor mechanisms. A torsion bar may couple scissor mechanisms at opposing ends of the agitator assembly 2200, wherein the torsion bar encourages both sides of the agitator assembly 2200 to move together. The lift mechanism 2202 may further include a biasing mechanism 2206 (e.g., a spring) configured to urge the agitator assembly 2200 towards the retracted position.

Figure 25:
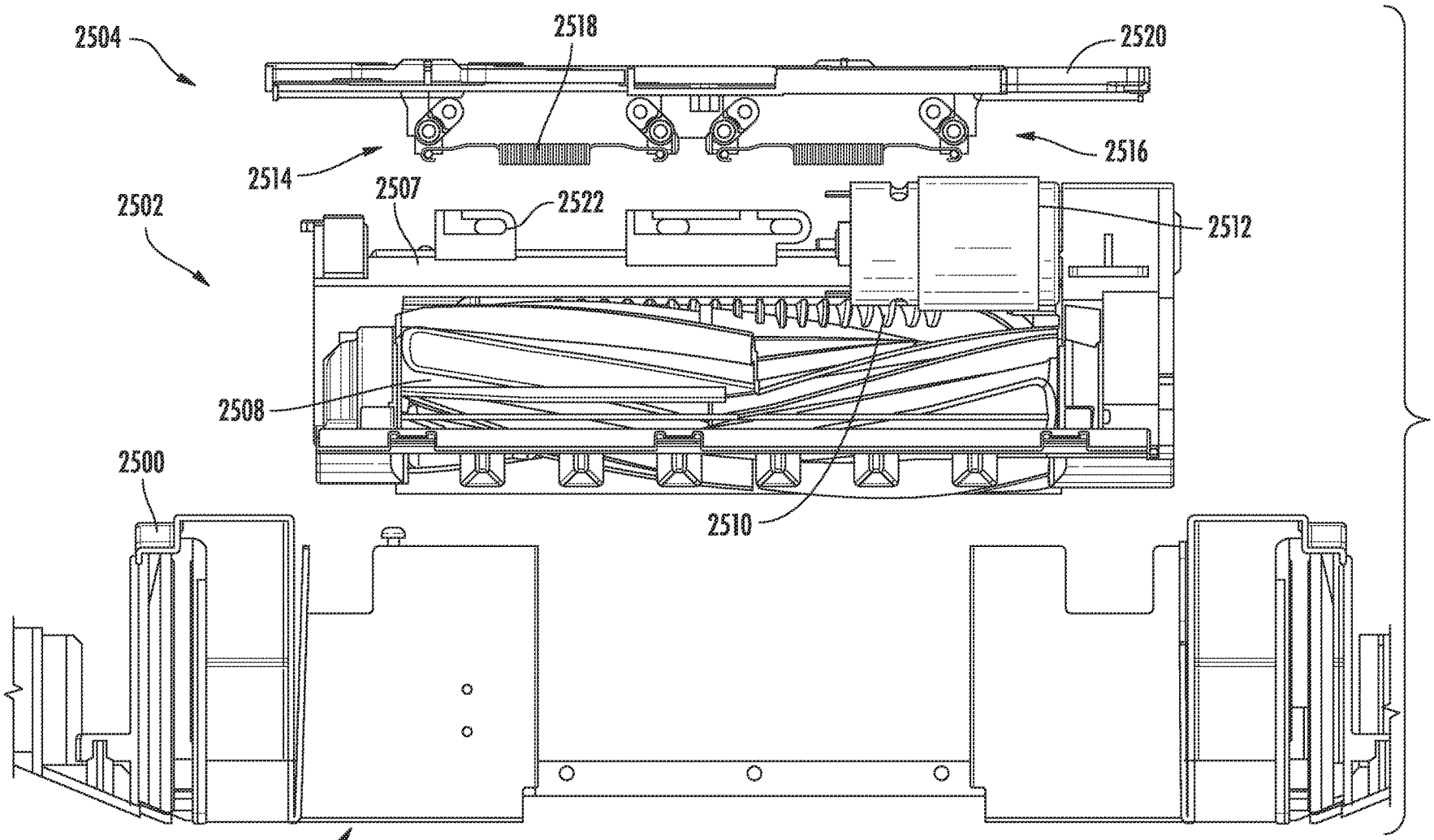
FIG. 25 is an exploded cross-sectional view of a robotic cleaner chassis, an agitator assembly, and a lift mechanism, consistent with embodiments of the present disclosure.

FIG. 25 shows an exploded cross-sectional view of a robotic cleaner chassis 2500, an agitator assembly 2502, and a lift mechanism 2504. As shown, the agitator assembly 2502 is configured to be movably received within a receptacle 2506 of the robotic cleaner chassis 2500. The agitator assembly 2502 may include a housing 2507, one or more agitators 2508, a comb 2510 configured to engage at least one of the one or more agitators 2508, and at least one motor 2512 configured to drive at least one of the one or more agitators 2508. The engagement between the comb 2510 and an agitator may be configured to remove fibrous debris (e.g., hair) from a respective one or more agitators 2508.

Figure 26:
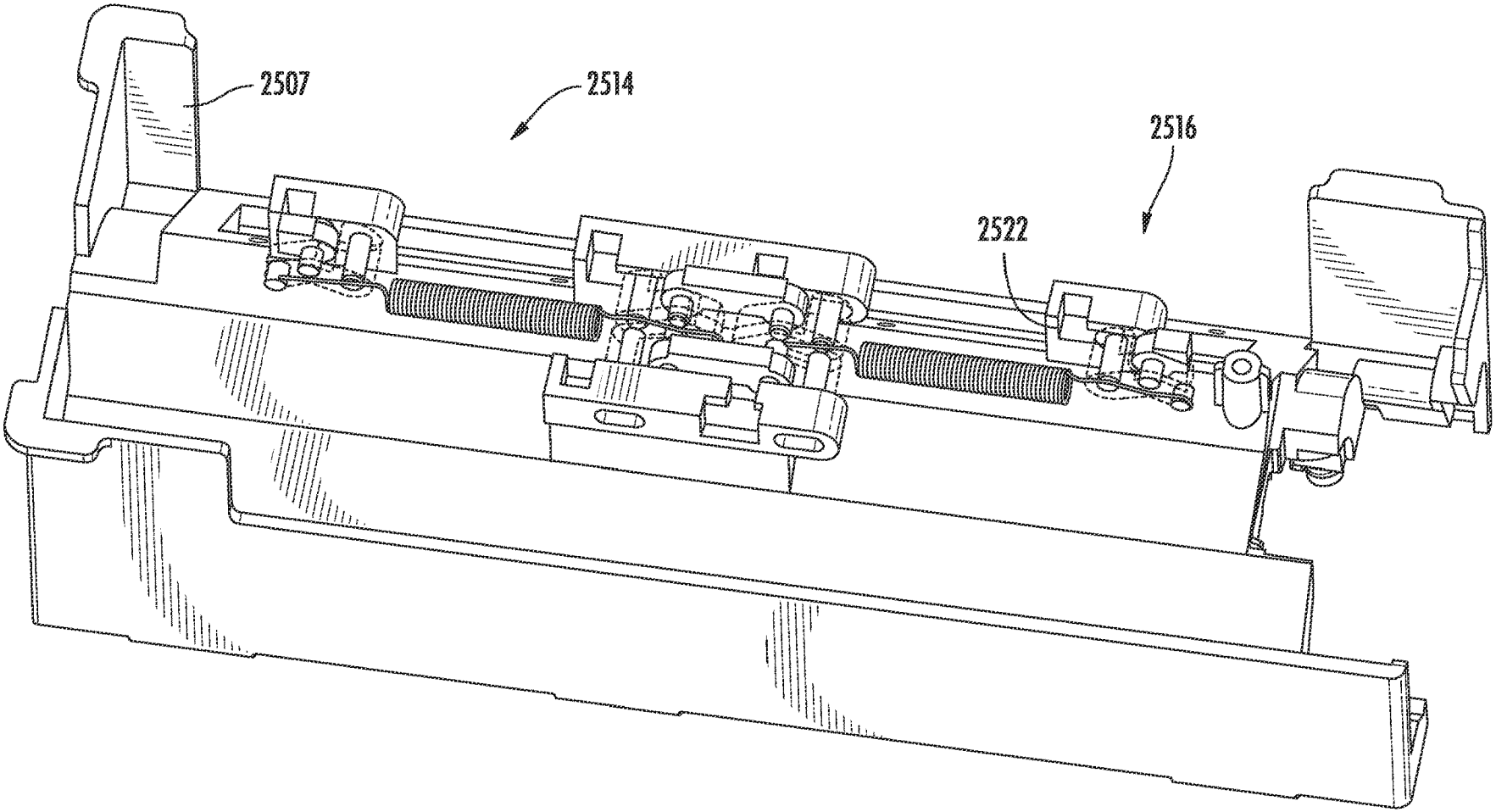
FIG. 26 is an example of a portion of the lift mechanism of FIG. 25 coupled to a portion of the agitator assembly of FIG. 25, consistent with embodiments of the present disclosure.

The lift mechanism 2504 includes a first set of linkages 2514, a second set of linkages 2516, and a plurality of biasing mechanisms 2518, wherein each biasing mechanism 2518 extends between a corresponding set of linkages 2514. The lift mechanism 2504 is configured to couple to the housing 2507 such that the housing 2507 is movable within the receptacle 2506. For example, and with additional reference to FIG. 26, the first and second sets of linkages 2514, 2516 may be pivotally coupled to a top plate 2520 of the lift mechanism 2504 and slidably coupled to the housing 2507 of the agitator assembly 2502 at corresponding tracks 2522. The top plate 2520 is configured to couple to the robotic cleaner chassis 2500.

Figure 27:
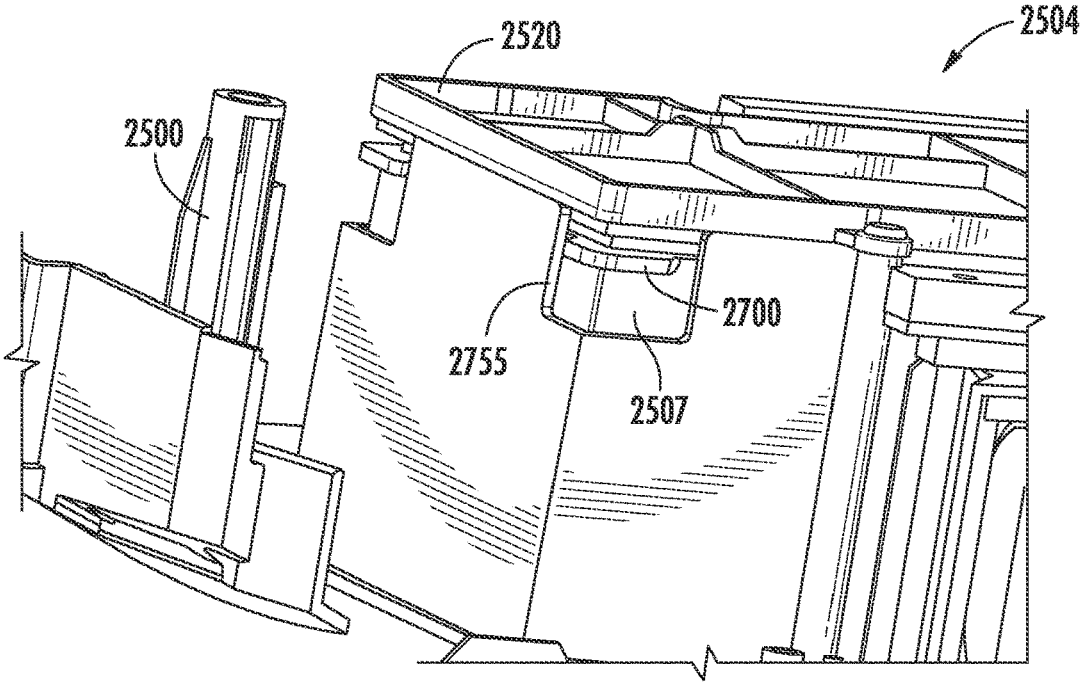
FIG. 27 is a magnified view of a portion of the robotic cleaner chassis, the lift mechanism, and the agitator assembly of FIG. 25, consistent with embodiments of the present disclosure.

FIG. 27 shows a magnified view of a portion of the robotic cleaner chassis 2500 coupled with the lift mechanism 2504. As shown, the housing 2507 of the agitator assembly 2502 includes a plurality of stops 2700 configured to move within respective slots 2755. When the stops 2700 reach distal ends of a respective slot 2755 further movement of the agitator assembly 2502 is prevented (e.g., as a result of contact with the robotic cleaner chassis 2500 and/or the top plate 2520, which may define a distal end of a respective slot 2755). As such, the stops 2700 can generally be described as defining the maximum extension and retraction positions of the lift mechanism 2504. In some instances, the stops 2700 may include a sound dampening material (e.g., a rubber or compressible foam) configured to reduce a quantity of noise generated when the stops 2700 engage a distal end of the slot 2755. Additionally, or alternatively, the slot 2755 may include a sound dampening material (e.g., at one or more distal ends of the slot 2755).

Figure 28:
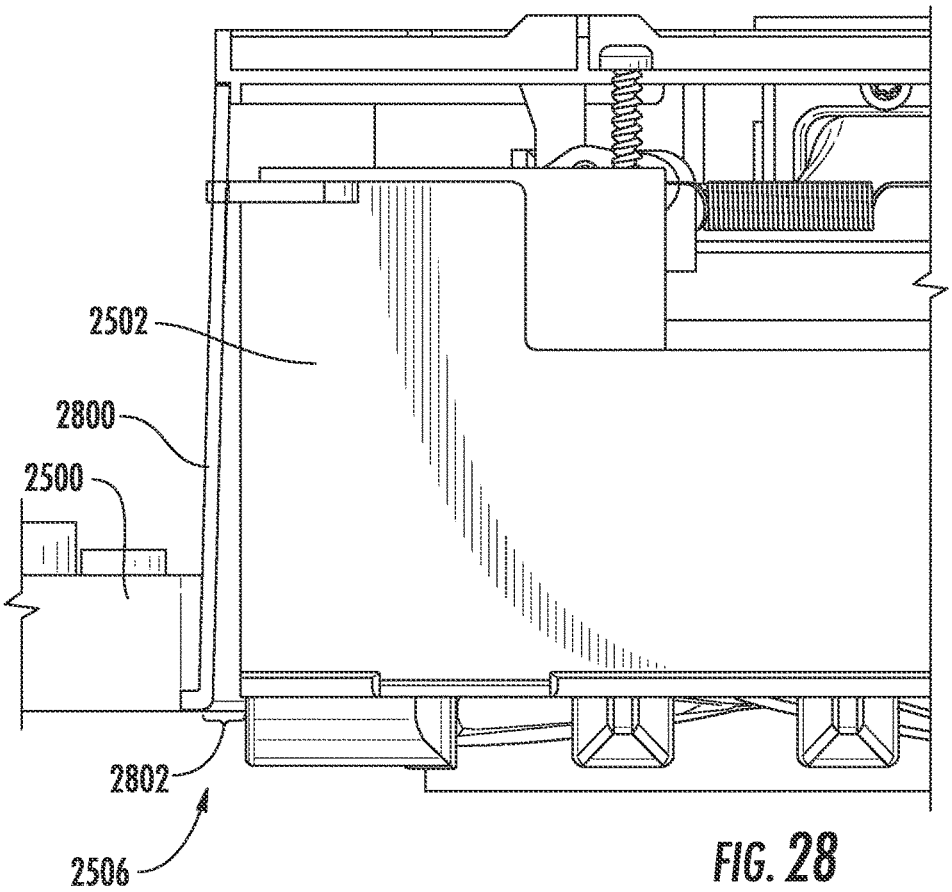
FIG. 28 is a magnified cross-sectional view of a portion of the robotic cleaner chassis, the lift mechanism, and the agitator assembly of FIG. 25, consistent with embodiments of the present disclosure.

FIG. 28 shows a magnified cross-sectional view of a portion of the robotic cleaner chassis 2500. As shown, one or more sidewalls 2800 defining the receptacle 2506 may extend transverse to (at a non-perpendicular angle) the agitator assembly 2502. For example, and as shown, a separation distance 2802 between the one or more sidewalls 2800 and the agitator assembly 2502 may increase with increasing distance from the lift mechanism 2504.

Embodiments of the methods described herein may be implemented using a controller, processor and/or other programmable device. To that end, the methods described herein may be implemented on a tangible, non-transitory, computer readable medium having instructions stored thereon that, when executed by one or more processors, perform the methods. Thus, for example, a controller may include a storage medium to store instructions (in, for example, firmware or software) to perform the operations described herein. The storage medium may include any type of tangible medium, for example, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions.

The functions of the various elements shown in the figures, including any functional blocks described as "controller," may be provided through the use of dedicated hardware as well as hardware capable of executing software in association with appropriate software. The functions may be provided by a single dedicated processor, by a single shared processor, or by a plurality of individual processors, some of which may be shared. Moreover, explicit use of the term "controller" should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random access memory (RAM), and non-volatile storage. Other hardware, conventional and/or custom, may also be included.

The term "coupled" as used herein refers to any connection, coupling, link or the like by which signals carried by one system element are imparted to the "coupled" element. Such "coupled" devices, or signals and devices, may be, but are not necessarily directly connected to one another and may be separated by intermediate components or devices that may manipulate or modify such signals. Likewise, the terms "connected" or "coupled" as used herein in regard to mechanical or physical connections or couplings is a relative term and may include, but does not require, a direct physical connection.

Elements, components, modules, and/or parts thereof that are described and/or otherwise portrayed through the figures to communicate with, be associated with, and/or be based on, something else, may be understood to so communicate, be associated with, and/or be based on in a direct and/or indirect manner, unless otherwise stipulated herein.

Unless otherwise stated, use of the word "substantially" or "approximately" may be construed to include a precise relationship, condition, arrangement, orientation, and/or other characteristic, and deviations thereof as understood by one of ordinary skill in the art, to the extent that such deviations do not materially affect the disclosed methods and systems. Throughout the entirety of the present disclosure, use of the articles "a" and/or "an" and/or "the" to modify a noun may be understood to be used for convenience and to include one, or more than one, of the modified noun, unless otherwise specifically stated. The terms "comprising," "including," and "having" are intended to be inclusive and mean that there may be additional elements other than the listed elements.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a surface cleaning apparatus may embody any one or more of the features contained herein and that the features may be used in any particular combination or sub-combination. Modifications and substitutions by one of ordinary skill in the art are considered to be within the scope of the present invention.

What is claimed is:

1. A robotic cleaner comprising:

a chassis;

an agitator assembly configured to engage a surface to be cleaned; and a lift moveably coupling the agitator assembly to the chassis, the lift including:

a spring configured to generate a biasing force that urges the agitator assembly in a direction away from the surface to be cleaned, the biasing force being insufficient to lift the agitator assembly from the surface to be cleaned;

a top plate;

a bottom plate; and a plurality of linkages, a first end of each linkage being pivotally coupled to the top plate and a second end of each linkage being slidably coupled to the bottom plate.

2. The robotic cleaner of claim 1, wherein the top plate is coupled to the chassis and the bottom plate is coupled to the agitator assembly.

3. The robotic cleaner of claim 2, wherein the spring is configured to urge the linkages to pivot towards each other.

4. The robotic cleaner of claim 1, wherein the spring is a tension spring.

5. The robotic cleaner of claim 1, wherein the spring is a leaf spring.

6. The robotic cleaner of claim 1, wherein the agitator assembly includes at least one motor.

7. The robotic cleaner of claim 6, wherein the lift includes a plurality of springs configured to cooperate to encourage an even weight distribution across the agitator assembly.

8. The robotic cleaner of claim 6, wherein the agitator assembly includes at least one agitator, the at least one agitator being configured to be rotated by the at least one motor.

9. The robotic cleaner of claim 6, wherein the agitator assembly includes at least one counterweight, the at least one counterweight and the at least one motor being positioned on opposing sides of the agitator assembly.

10. A robotic cleaner comprising:

a chassis;

a suction motor;

a dust cup fluidly coupled to the suction motor;

an agitator assembly configured to engage a surface to be cleaned, the agitator assembly including:

a suction conduit that is fluidly coupled to the dust cup and the suction motor, wherein the suction motor is configured to cause air to pass through the suction conduit, into the dust cup, and through the suction motor; and an agitator at least partially disposed within the suction conduit, wherein the agitator rotates about a rotation axis that extends substantially parallel to the surface to be cleaned; and a lift moveably coupling the agitator assembly to the chassis, the lift including a spring configured to generate a biasing force that urges the agitator assembly in a direction away from the surface to be cleaned, the biasing force being insufficient to lift the agitator assembly from the surface to be cleaned.

11. The robotic cleaner of claim 10, wherein a bellow fluidly couples the agitator assembly to the dust cup.

12. The robotic cleaner of claim 10, wherein the lift includes a top plate, a bottom plate, and a plurality of linkages, a first end of each linkage being pivotally coupled to the top plate and a second end of each linkage being slidably coupled to the bottom plate.

13. The robotic cleaner of claim 12, wherein the top plate is coupled to the chassis and the bottom plate is coupled to the agitator assembly.

14. The robotic cleaner of claim 13, wherein the spring is configured to urge the linkages to pivot towards each other.

15. The robotic cleaner of claim 10, wherein the spring is a tension spring.

16. The robotic cleaner of claim 10, wherein the spring is a leaf spring.

17. The robotic cleaner of claim 10, wherein the agitator assembly includes at least one motor.

18. The robotic cleaner of claim 17, wherein the lift includes a plurality of springs configured to cooperate to encourage an even weight distribution across the agitator assembly.

19. The robotic cleaner of claim 17, wherein the agitator assembly includes at least one counterweight, the at least one counterweight and the at least one motor being positioned on opposing sides of the agitator assembly.

20. A robotic cleaner comprising:

a chassis;

an agitator assembly configured to engage a surface to be cleaned, wherein the agitator assembly includes at least one motor; and a lift moveably coupling the agitator assembly to the chassis, the lift including a plurality of springs configured to:

generate a biasing force that urges the agitator assembly in a direction away from the surface to be cleaned, the biasing force being insufficient to lift the agitator assembly from the surface to be cleaned; and cooperate to encourage an even weight distribution across the agitator assembly.

* * * * *